US008454734B2

(12) United States Patent
Haruna et al.

(10) Patent No.: US 8,454,734 B2
(45) Date of Patent: Jun. 4, 2013

(54) CHARGING DEVICE, AIR HANDLING DEVICE, METHOD FOR CHARGING, AND METHOD FOR HANDLING AIR

(75) Inventors: Shunji Haruna, Osaka (JP); Toshio Tanaka, Osaka (JP); Kanji Motegi, Osaka (JP); Ryuji Akiyama, Osaka (JP)

(73) Assignee: Daikin Industries, Ltd., Osaka-Shi (JP)

( * ) Notice: Subject to any disclaimer, the term of this patent is extended or adjusted under 35 U.S.C. 154(b) by 477 days.

(21) Appl. No.: 12/740,309

(22) PCT Filed: Oct. 8, 2008

(86) PCT No.: PCT/JP2008/002840

§ 371 (c)(1),
(2), (4) Date: Apr. 28, 2010

(87) PCT Pub. No.: WO2009/057250

PCT Pub. Date: May 7, 2009

(65) Prior Publication Data

US 2010/0251889 A1 Oct. 7, 2010

(30) Foreign Application Priority Data

Oct. 29, 2007 (JP) ..... 2007-279957
Aug. 18, 2008 (JP) ..... 2008-209716

(51) Int. Cl.
*B03C 3/12* (2006.01)

(52) U.S. Cl.
USPC ..... 96/77; 96/97

(58) Field of Classification Search
USPC ..... 96/77–79, 97; 95/79; 361/225–235
See application file for complete search history.

(56) References Cited

U.S. PATENT DOCUMENTS

| | | | | |
|---|---|---|---|---|
| 3,803,808 | A | 4/1974 | Shibuya et al. | |
| 4,018,577 | A | 4/1977 | Shibuya et al. | |
| 4,265,641 | A * | 5/1981 | Natarajan | 95/79 |
| 4,643,745 | A | 2/1987 | Sakakibara et al. | |
| 4,713,092 | A * | 12/1987 | Kikuchi et al. | 96/70 |
| 4,778,493 | A | 10/1988 | Fitch et al. | |
| 5,466,279 | A * | 11/1995 | Hattori et al. | 96/69 |
| 5,547,496 | A * | 8/1996 | Hara | 96/79 |
| 5,733,360 | A * | 3/1998 | Feldman et al. | 95/78 |

(Continued)

FOREIGN PATENT DOCUMENTS

| | | |
|---|---|---|
| EP | 1 655 595 A1 | 11/2004 |
| EP | 1 681 550 A1 | 1/2005 |
| JP | 45-31518 | 10/1970 |

(Continued)

OTHER PUBLICATIONS

Biskos et al., "Electrostatic Characterisation of Corona-Wire Aerosol Chargers", Journal of Electrostatics Elsevier Netherlands, vol. 63, No. 1, pp. 69-82 (2005).

*Primary Examiner* — Richard L Chiesa
(74) *Attorney, Agent, or Firm* — Birch, Stewart, Kolasch & Birch, LLP

(57) ABSTRACT

The present invention relates to a charging device having a charge section (20) for charging a floating particle in an air to be handled, and an air handling device (an air cleaning device) having the charging device. The charge section (20) is constituted by a first charge section (20*a*) adopting an impact charging technique and a second charge section (20*b*) adopting a diffusion charging technique. With this structure, charging and collection of dust can be accomplished only in the casing of the device, and therefore, an increase in size of the device can be avoided.

18 Claims, 21 Drawing Sheets

U.S. PATENT DOCUMENTS

| | | | | |
|---|---|---|---|---|
| 6,004,376 | A * | 12/1999 | Frank | 95/79 |
| 6,251,171 | B1 * | 6/2001 | Marra et al. | 96/69 |
| 6,932,857 | B1 * | 8/2005 | Krigmont | 95/63 |
| 7,019,244 | B2 * | 3/2006 | Weaver et al. | 209/127.1 |
| 2006/0016337 | A1 * | 1/2006 | Taylor et al. | 96/25 |
| 2006/0150754 | A1 | 7/2006 | Burtscher et al. | |

FOREIGN PATENT DOCUMENTS

| | | | | |
|---|---|---|---|---|
| JP | 49-54971 | A | 5/1974 | |
| JP | 49-83969 | A | 8/1974 | |
| JP | 49-111885 | A | 9/1974 | |
| JP | 49-130573 | A | 12/1974 | |
| JP | 50-52674 | A | 5/1975 | |
| JP | 50-111779 | U | 9/1975 | |
| JP | 54-136476 | A * | 10/1979 | 96/79 |
| JP | 60-153958 | A | 8/1985 | |
| JP | 6-7704 | A | 1/1994 | |
| JP | 2001-286786 | A | 10/2001 | |
| JP | 2006-116492 | A | 5/2006 | |
| JP | 3136006 | U | 10/2007 | |
| SU | 1 035 477 | A1 | 8/1983 | |
| SU | 1 667 929 | A1 | 8/1991 | |

* cited by examiner

FIG.9

| | Conditions | Dust Collection Efficiency(%) | Proportion of Diffusion Charging Current |
|---|---|---|---|
| ① | Two Counter Electrodes | 93.4 | 27.5 |
| | Diameter of Counter Electrode: $\phi$ 1.5mm | | |
| | Distance between Sawtooth and Counter Electrode: d=17.5mm | | |
| | Number of Sawtooth on Upstream Side: 5 | | |
| | Number of Sawtooth on Downstream Side: 5 | | |
| ② | Two Counter Electrodes | 90.6 | 22.2 |
| | Diameter of Counter Electrode: $\phi$ 1.5mm | | |
| | Distance between Sawtooth and Counter Electrode: d=17.5mm | | |
| | Number of Sawtooth on Upstream Side: 9 | | |
| | Number of Sawtooth on Downstream Side: 9 | | |
| ③ | Two Counter Electrodes | 89.4 | 25.5 |
| | Diameter of Counter Electrode: $\phi$ 1.5mm | | |
| | Distance between Sawtooth and Counter Electrode: d=17.5mm | | |
| | Number of Sawtooth on Upstream Side: 5 | | |
| | Number of Sawtooth on Downstream Side: 9 | | |
| ④ | Two Counter Electrodes | 84.8 | 29.4 |
| | Diameter of Counter Electrode: $\phi$ 1.5mm | | |
| | Distance between Sawtooth and Counter Electrode: d=17.5mm | | |
| | Number of Sawtooth on Upstream Side: 3 | | |
| | Number of Sawtooth on Downstream Side: 9 | | |
| ⑤ | Two Counter Electrodes | 82.6 | 29.6 |
| | Diameter of Counter Electrode: $\phi$ 1.0mm | | |
| | Distance between Sawtooth and Counter Electrode: d=17.5mm | | |
| | Number of Sawtooth on Upstream Side: 5 | | |
| | Number of Sawtooth on Downstream Side: 5 | | |
| ⑥ | Four Counter Electrodes | 80.0 | 21.5 |
| | Diameter of Counter Electrode: $\phi$ 1.5mm | | |
| | Distance between Sawtooth and Counter Electrode: d=17.5mm | | |
| | Number of Sawtooth on Upstream Side: 5 | | |
| | Number of Sawtooth on Downstream Side: 5 | | |

FIG.15
(A)
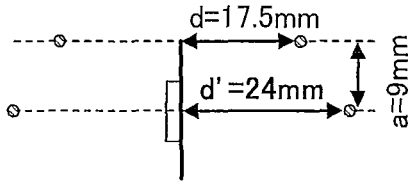
d'=24mm, a=9mm
(B)
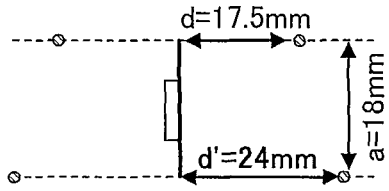
d'=24mm, a=18mm
(C)
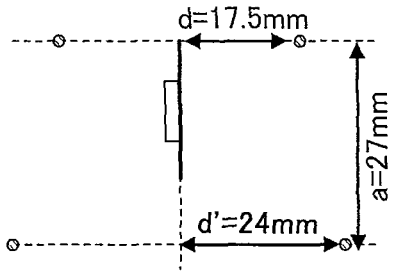
d' =24mm, a=27mm FIG.16
(A)
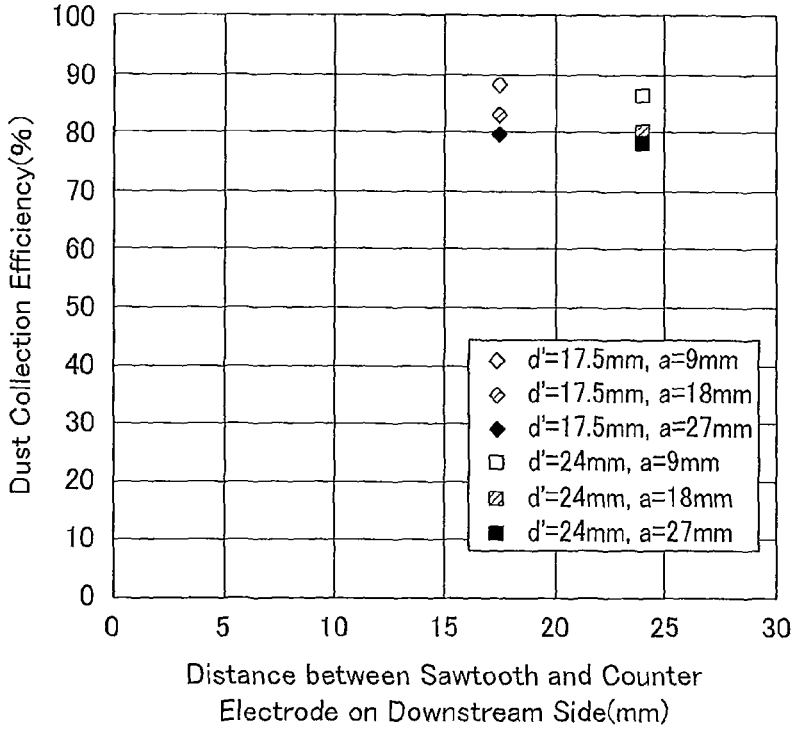
(B)
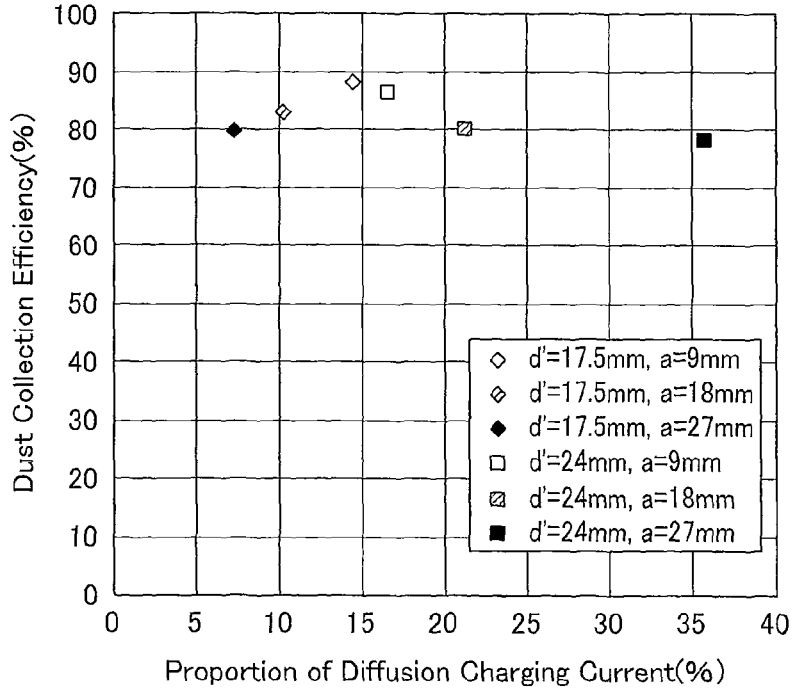

FIG.22
(A)
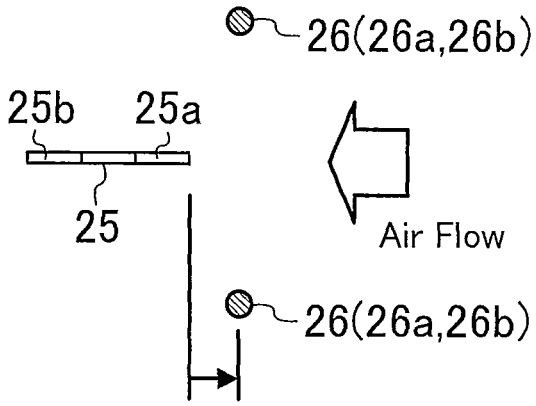
(B)
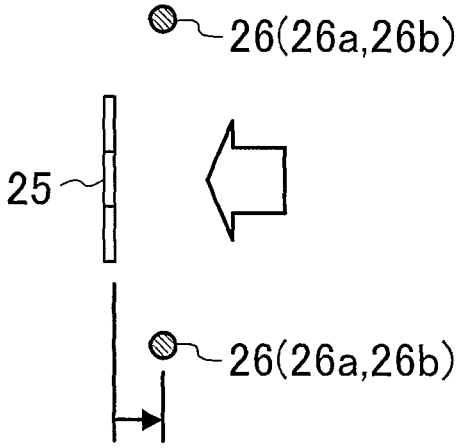

FIG.27
(A)
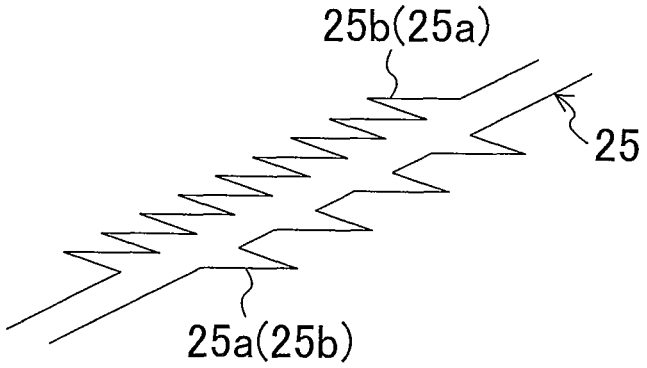
(B)
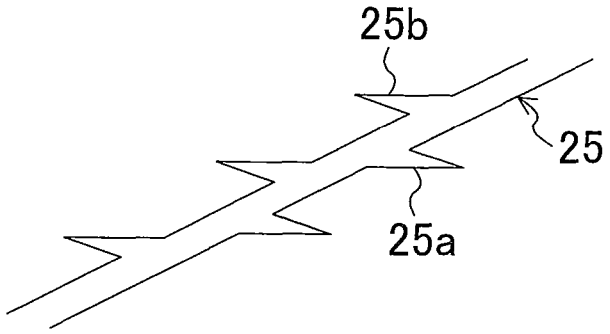
(C)
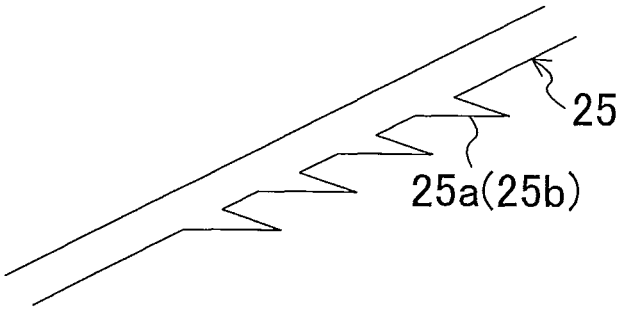

FIG.28
(A)
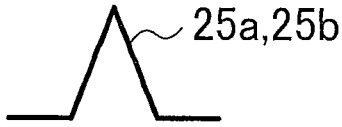
(B)
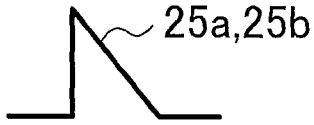
(C)
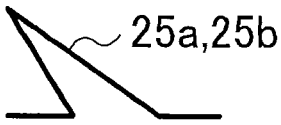

FIG.29
(A)
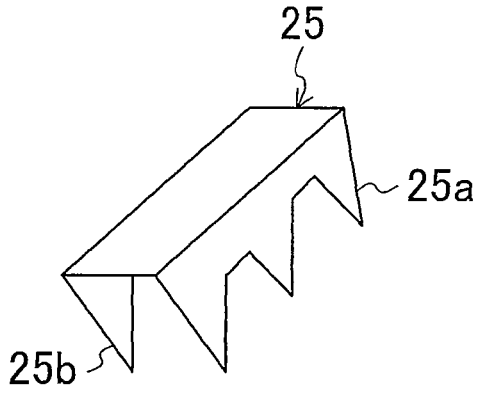
(B)
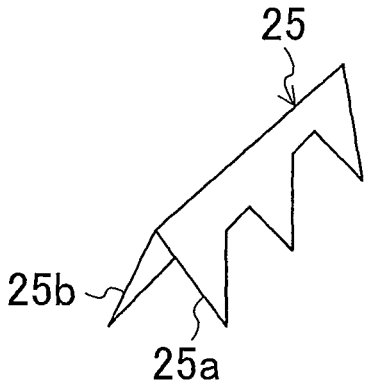

CHARGING DEVICE, AIR HANDLING DEVICE, METHOD FOR CHARGING, AND METHOD FOR HANDLING AIR

TECHNICAL FIELD

The present invention relates to charging devices and charging methods for charging particles such as dust in the air to be handled, and air handling devices and air handling methods for collecting the charged dust, and specifically relates to techniques for reliably charging floating particles, such as dust, in a small space.

BACKGROUND ART

Patent Document 1 shows, as a conventional air handling device, an air cleaning device in which a charging unit having a charge section is detachable from the body having a precipitator. According to this air cleaning device, ions generated at the charging unit are dispersed in a room and combined with the dust suspended in the air, and thereby the dust is charged. This dust is drawn into the body of the air cleaning device by a fan, and is collected at the precipitator.

CITATION LIST

PATENT DOCUMENT 1: Japanese Patent Publication No. 2006-116492

SUMMARY OF THE INVENTION

Technical Problem

However, according to the device in Patent Document 1, the dust is ionized in a room. Therefore, dust may adhere to the walls of the room before the dust is taken into the precipitator, and the walls may become soiled.

Moreover, in general, a large space is necessary to implement the technique shown in Patent Document 1, in which dust is charged by dispersed ions. Thus, an attempt to accomplish the charging and collection of dust only in the casing of the air cleaning device results in an increase in size of the casing. Therefore, implementation of the device is difficult.

The present invention was made in view of the above problems, and it is an objective of the invention to accomplish charging and collection of dust only in the casing, and moreover to avoid an increase in size of the device, in a charging device and a charging method, and an air handling device and an air handling method, which use a technique in which ions generated at a charge section are dispersed.

Solution to the Problem

The first aspect of the present invention is intended for a charging device including a charge section (20) for charging a floating particle in an air to be handled.

The charge section (20) of the charging device includes a first charge section (20*a*) adopting an impact charging technique and a second charge section (20*b*) adopting a diffusion charging technique.

According to the first aspect of the present invention, floating particles in the air are charged when the floating particles pass through the first charge section (20*a*) adopting an impact charging technique and the second charge section (20*b*) adopting a diffusion charging technique. Since both of the diffusion charging technique and the impact charging technique are used in the present invention, it is possible to reduce a space necessary for charging the floating particles at the second charge section (20*b*). Further, since the space for the diffusion charging can be reduced, it is possible to complete the charging of the floating particles, such as dust, in the casing of the device.

The second aspect of the present invention according to the first aspect of the present invention is that a discharge electrode (25) provided at the second charge section (20*b*) is a plate-like electrode having generally rectangular, plate-like projections provided at predetermined intervals along at least one edge of a band-like member.

In the second aspect of the present invention, an electrode having generally rectangular, plate-like projections is used for the discharge electrode (25) of the second charge section (20*b*) adopting a diffusion charging technique. The plate-like projections are sharp-tipped, like a shape of a needle-like electrode, and therefore, the electric field concentrates at the tips of the discharge electrode (25). Consequently, ions are emitted more easily.

The third aspect of the present invention according to the first aspect of the present invention is that a discharge electrode (25) provided at the second charge section (20*b*) is a sawtooth electrode.

In the third aspect of the present invention, a sawtooth electrode is used for the discharge electrode (25) of the second charge section (20*b*) adopting a diffusion charging technique. The sawtooth electrode is sharp-tipped, like a shape of a needle-like electrode, and therefore, the electric field concentrates at the tips of the discharge electrode (25). Consequently, ions tend to be emitted more easily.

The fourth aspect of the present invention according to the first aspect of the present invention is that a discharge electrode (25) provided at the second charge section (20*b*) is a needle-like electrode.

In the fourth aspect of the present invention, a needle-like electrode is used for the discharge electrode (25) of the second charge section (20*b*) adopting a diffusion charging technique. Consequently, the electric field concentrates at the tips of the discharge electrode (25), and as a result, ions are emitted more easily.

The fifth aspect of the present invention according to the second, third or fourth aspect of the present invention is that a counter electrode (26) provided at the second charge section (20*b*) is positioned at a location shifted from a discharge direction of the discharge electrode (25).

In the fifth aspect of the present invention, the counter electrode (26) is positioned at a location shifted from a direction along which ions are emitted from the discharge electrode (25) of the second charge section (20*b*). This structure reduces the likelihood of the ions reaching the counter electrode (26). Therefore, the ions can be easily diffused in the air.

The sixth aspect of the present invention according to any one of the first to fifth aspects of the present invention is that the first charge section (20*a*) is positioned on an upstream side of a direction of the air to be handled, and the second charge section (20*b*) is positioned on a downstream side of the direction of the air to be handled.

In the sixth aspect of the present invention, the air to be handled passes through the first charge section (20*a*) first, and then, passes through the second charge section (20*b*). Here, a comparison between the first charge section (20*a*) adopting an impact charging technique and the second charge section (20*b*) adopting a diffusion charging technique shows that if a charging time is short, the amount of charge by the impact charging technique is larger than the amount of charge by the diffusion charging technique, and in contrast, if the charging time is long, the amount of charge by the diffusion charging technique is larger than the amount of charge by the impact charging technique. Thus, using the impact charging technique on the upstream side of an air flow and the diffusion charging technique on the downstream side of the air flow results in obtaining sufficient amount of charge relatively easily.

The seventh aspect of the present invention according to the sixth aspect of the present invention is that a discharge electrode (25*a*) of the first charge section (20*a*) and a discharge electrode (25*b*) of the second charge section (20*b*) are constituted by an integral discharge electrode (25); and a counter electrode (26*a*) of the first charge section (20*a*) is located on the air flow upstream side, and a counter electrode (26*b*) of the second charge section (20*b*) is located on the air flow downstream side, relative to the discharge electrode (25).

In the seventh aspect of the present invention, a discharge electrode (25*a*) of the first charge section (20*a*) and a discharge electrode (25*b*) of the second charge section (20*b*) are integrally formed with each other, and the first charge section (20*a*) is located on the air flow upstream side of the second charge section (20*b*). Thus, it is possible to simplify the structure of the discharge electrode (25), and obtain a sufficient amount of charge.

The eighth aspect of the present invention according to the seventh aspect of the present invention is that the integral discharge electrode (25) includes a first discharge section (25*a*) which constitutes the discharge electrode (25*a*) of the first charge section (20*a*), and a second discharge section (25*b*) which constitutes the discharge electrode (25*b*) of the second charge section (20*b*); the counter electrode (26*a*) of the first charge section (20*a*) and the counter electrode (26*b*) of the second charge section (20*b*) are constituted by an integral counter electrode (26); and the integral counter electrode (26) is located closer to the first discharge section (25*a*) than to the second discharge section (25*b*).

In the eighth aspect of the present invention, counter electrodes (26) are integrally formed with each other, and the integral counter electrode (26) is located close to the first discharge section (25*a*) which is placed on the upstream side of the second discharge section (25*b*) placed on a downstream side of the direction of the air to be handled. The structure can thus be simplified. In addition, an impact charging tends to occur between the first discharge section (25*a*) and the counter electrode (26), and a diffusion charging tends to occur between the second discharge section (25*b*) and the counter electrode (26).

The ninth aspect of the present invention according to any one of the first to eighth aspects of the present invention is that a counter electrode (26) of the second charge section (20*b*) is a rod-like electrode having a polygonal cross section and obtuse-angled corners.

The tenth aspect of the present invention according to any one of the first to eighth aspects of the present invention is that a counter electrode (26) of the second charge section (20*b*) is a rod-like electrode having a circular cross section.

In the ninth and tenth aspects of the present invention, the electric field does not concentrate at the edges of the counter electrode (26). Thus, ions tend to be diffused relatively easily.

The eleventh aspect of the present invention according to the ninth or tenth aspect of the present invention is that a diagonal dimension or a diameter of the counter electrode (26) of the second charge section (20*b*) is one fifth or less of a distance between the discharge electrode (25) and the counter electrode (26), and is greater than zero (mm).

In the eleventh aspect of the present invention, the diameter or the diagonal dimension of the counter electrode (26) is small enough, compared to the distance between the discharge electrode (25) and the counter electrode (26). This means that the surface area of the counter electrode (26) is reduced, and therefore, it is possible to reduce absorption of ions.

The twelfth aspect of the present invention according to any one of the ninth to eleventh aspects of the present invention is that a space (S1) is provided in a region opposite to the discharge electrode (25), relative to the counter electrode (26) of the second charge section (20*b*).

In the twelfth aspect of the present invention, electric force lines which curve and reach a space behind the counter electrode (26) (a space (S1) opposite to the discharge electrode (25)) are generated by the discharge electrode (25) and the counter electrode (26). Ions tend to be absorbed into the counter electrode (26) if emitted along a linear electric force line generated between the discharge electrode (25) and the counter electrode (26). On the other hand, ions tend not to be absorbed into the counter electrode (26) if emitted along an electric force line which curves and reaches the space behind the counter electrode (26). Therefore, diffused components of the ions are generated in the space (S1), in which diffusion charging occurs.

The thirteenth aspect of the present invention according to any one of the ninth to eleventh aspects of the present invention is that a space (S2) is provided around an entire periphery of the counter electrode (26) of the second charge section (20*b*).

In the thirteenth aspect of the present invention, electric force lines which curve and reach the space behind the counter electrode (26) are generated as well, as in the twelfth aspect of the present invention. Therefore, diffused components of the ions are generated in the space (S2), in which diffusion charging occurs.

The fourteenth aspect of the present invention according to the twelfth or thirteenth aspect of the present invention is that the counter electrode (26) of the second charge section (20*b*) is located in an air flow path along which the air to be handled flows.

In the fourteenth aspect of the present invention, the counter electrode (26) of the second charge section (20*b*) is located in an air flow path along which the air to be handled flows. Thus, ions which have been emitted from the discharge electrode (25) of the second charge section (20*b*) and which are supposed to be injected to the counter electrode (26) are affected by the air flow, and are diffused in the air without being incident into the counter electrode (26).

The fifteenth aspect of the present invention according to any one of the first to fourteenth aspects of the present invention is that if an electric current flowing in the discharge electrode (25) is represented by I1 and an electric current flowing in the counter electrode (26) is represented by 12, both an impact charging current (I2) and an diffusion charging current (I1-I2) flow in both of the electrodes (25, 26).

In the fifteenth aspect of the present invention, if the current flowing in the counter electrode (26) is smaller than the current flowing in the discharge electrode (25), a difference between the current flowing in the counter electrode (26) and the current flowing in the discharge electrode (25) is a diffusion charging current (I1-I2) at the second charge section (20*b*). If there is a current flowing in the counter electrode (26), that current is an impact charging current (I2) at the first charge section (20*a*). In other words, the existence of these two types of currents means that the impact charging and the diffusion charging are occurring at the same time.

The sixteenth aspect of the present invention according to the fifteenth aspect of the present invention is that a proportion of the diffusion charging current is 5% or more and 60% or less of an overall electric current.

Further, the seventeenth aspect of the present invention according to the sixteenth aspect of the present invention is that the proportion of the diffusion charging current is 10% or more and 30% or less of the overall electric current. The eighteenth aspect of the present invention according to the seventeenth aspect of the present invention is that the proportion of the diffusion charging current is 15% or more and 30% or less of the overall electric current.

The proportion of the diffusion charging current is 5% or more and 60% or less of an overall electric current in the sixteenth aspect of the present invention; the proportion of the same is 10% or more and 30% or less of the overall electric current in the seventeenth aspect of the present invention; and the proportion of the same is 15% or more and 30% or less of the overall electric current in the eighteenth aspect of the present invention. This means that the impact charging technique and the diffusion charging technique can be effectively used. In other words, charged ions can be diffused in sufficient amounts, and therefore, particles of submicron-order (less than 1 nm) can be efficiently charged.

The nineteenth aspect of the present invention is intended for an air handling device including a charge section (20) for charging dust in an air to be handled, and a precipitator (30) for collecting the charged dust.

One of characteristics of the air handling device is that the charge section (20) is constituted by the charging device of any one of the first to eighteenth aspects of the present invention that includes a first charge section (20*a*) adopting an impact charging technique and a second charge section (20*b*) adopting a diffusion charging technique.

In the nineteenth aspect of the present invention, the air handling device adopts both of the impact charging technique and the diffusion charging technique. Therefore, floating particles in the air, such as dust, ranging from micron-order (1 μm or more) to submicron-order (less than 1 μm) can be efficiently charged and captured. Further, the use of both of the impact charging technique and the diffusion charging technique enables completion of charging of dust or the like within the casing of the device. In addition, the device size can be reduced.

The twentieth aspect of the present invention is intended for a charging method in which a charging process for charging a floating particle in an air to be handled is performed.

One of the characteristics of the charging method is that the charging process includes a first charging process adopting an impact charging technique and a second charging process adopting a diffusion charging technique.

In the twentieth aspect of the present invention, floating particles in the air are charged by the first charging process adopting an impact charging technique and the second charging process adopting a diffusion charging technique. Since both of the diffusion charging technique and the impact charging technique are used in the present invention, it is possible to reduce a space necessary for charging the floating particles at the second charge section (20*b*). Further, since the space for the diffusion charging can be reduced, it is possible to complete the charging of the floating particles, such as dust, in the casing of the device which uses this method.

The twenty-first aspect of the present invention is intended for an air handling method in which a charging process for charging dust in an air to be handled, and an electrostatic precipitation process for electrostatically collecting the charged dust are performed.

One of the characteristics of the air handling method is that the charging process is the charging process of the twentieth aspect of the present invention that includes a first charging process adopting an impact charging technique and a second charging process adopting a diffusion charging technique.

In the twenty-first aspect of the present invention, the air handling method includes both of the impact charging technique and the diffusion charging technique. Therefore, floating particles in the air, such as dust, ranging from micron-order to submicron-order, can be efficiently charged and captured. Further, since both of the impact charging technique and the diffusion charging technique are used, it is possible to complete the charging of the floating particles, such as dust, in the casing of the device using this method. In addition, the device size can be reduced.

ADVANTAGES OF THE INVENTION

According to the present invention, the charge section (20) adopts both of the diffusion charging technique and the impact charging technique by including the first charge section (20*a*) adopting the impact charging technique and the second charge section (20*b*) adopting the diffusion charging technique. Therefore, it is possible to reduce a space necessary for charging the floating particles at the second charge section (20*b*). Further, since the space for the diffusion charging can be reduced, it is possible to complete the charging of the floating particles, such as dust, in the casing of the device. Moreover, in general, one of the characteristics of the impact charging technique is that floating particles of micron-order (1 μm or more) tend to be charged in the impact charging technique, and one of the characteristics of the diffusion charging technique is that floating particles of submicron-order (less than 1 μm) tend to be charged in the diffusion charging technique. Thus, particles in a wider range of particle size can be charged, compared to the case where only the impact charging technique or only the diffusion charging technique is used.

According to the second aspect of the present invention, an electrode having generally rectangular projections is used for the discharge electrode (25*b*) of the second charge section (20*b*) adopting the diffusion charging technique. The projections are sharp-tipped, like a shape of a needle-like electrode, and therefore, the electric field concentrates at the tips of the discharge electrode (25*b*). Consequently, ions are emitted more easily. With this structure, discharge efficiency of the second charge section (20*b*) can be enhanced, and as a result, the device size can be reduced.

According to the third aspect of the present invention, a sawtooth electrode is used for the discharge electrode (25*b*) of the second charge section (20*b*) adopting the diffusion charging technique. The sawtooth electrode is sharp-tipped, like a shape of a needle-like electrode, and therefore, the electric field concentrates at the tips of the discharge electrode (25*b*). Consequently, ions tend to be emitted more easily. With this structure, discharge efficiency of the second charge section (20*b*) can be enhanced, and as a result, the device size can be reduced.

According to the fourth aspect of the present invention, a needle-like electrode is used for the discharge electrode (25*b*) of the second charge section (20*b*) adopting the diffusion charging technique. Consequently, the electric field concentrates at the tips of the discharge electrode (25*b*), and as a result, ions are emitted more easily. With this structure, discharge efficiency of the second charge section (20*b*) can be enhanced, and as a result, the device size can be reduced.

According to the fifth aspect of the present invention, a counter electrode (26) is positioned at a location shifted from a discharge direction of the ions from the discharge electrode (25) provided at the second charge section (20*b*). This structure reduces the likelihood of the ions reaching the counter electrode (26). Therefore, the ions can be easily diffused in the air. In other words, it is possible to reduce the likelihood of the ions being absorbed in the counter electrode (26), and increase a proportion of diffused components to all of the ions which have been discharged.

According to the sixth aspect of the present invention, the first charge section (20*a*) is positioned on an upstream side of a flow direction of the air to be handled, and the second charge section (20*b*) is positioned on a downstream side of the direction of the air to be handled. Thus, the air to be handled passes through the first charge section (20*a*) first, and then, passes through the second charge section (20*b*). Here, a comparison between the first charge section (20*a*) adopting an impact charging technique and the second charge section (20*b*) adopting a diffusion charging technique shows that if a charging time is short, the amount of charge by the impact charging technique is larger than the amount of charge by the diffusion charging technique, and in contrast, if the charging time is long, the amount of charge by the diffusion charging technique is larger than the amount of charge by the impact charging technique. Thus, using the impact charging technique on the upstream side of an air flow and the diffusion charging technique on the downstream side of the air flow results in obtaining sufficient amount of charge relatively easily, and efficiency of the charge section (20) as a whole is increased.

According to the seventh aspect of the present invention, a discharge electrode (25) of the first charge section (20*a*) and a discharge electrode (25) of the second charge section (20*b*) are integrally formed with each other, and the first charge section (20*a*) is located on the upstream side of the second charge section (20*b*). Thus, it is possible to simplify the structure of the discharge electrode (25) and obtain a sufficient amount of charge. It is therefore possible to increase efficiency of the charge section (20) as a whole.

According to the eighth aspect of the present invention, counter electrodes (26*a*, 26*b*) are integrally formed with each other, and the integral counter electrode (26) is located close to the first discharge section (25*a*) which is placed on the upstream side of the second discharge section (25*b*) placed on a downstream side of the direction of the air to be handled. The structure can thus be simplified. In addition, an impact charging tends to occur between the first discharge section (25*a*) on the upstream side and the counter electrode (26), and a diffusion charging tends to occur between the second discharge section (25*b*) on the downstream side and the counter electrode (26). Thus, it is possible to increase efficiency of the charge section (20) as a whole.

According to the ninth and tenth aspects of the present invention, the counter electrode (26) of the second charge section (20*b*) is a rod-like electrode having a polygonal cross section and obtuse-angled corners, or by a rod-like electrode having a circular cross section. Therefore, the electric field does not concentrate at the edges of the counter electrode (26), and thus, ions tend to be diffused relatively easily. As a result, efficiency of diffusion charging improves.

According to the eleventh aspect of the present invention, the diameter or the diagonal dimension of the counter electrode (26) is small enough, compared to the distance between the discharge electrode (25) and the counter electrode (26). This means that the surface area of the counter electrode (26) is reduced, and therefore, it is possible to reduce absorption of ions. This results in increase of a proportion of diffused components to all of the ions generated at the second charge section (20*b*). Thus, particles of submicron-order can be efficiently charged.

According to the twelfth aspect of the present invention, electric force lines which curve and reach a space behind the counter electrode (26) (a space (S1) opposite to the discharge electrode (25)) are generated by the discharge electrode (25) and the counter electrode (26). Ions tend to be absorbed into the counter electrode (26) if emitted along a linear electric force line generated between the discharge electrode (25) and the counter electrode (26). On the other hand, ions tend not to be absorbed into the counter electrode (26) if emitted along an electric force line which curves and reaches a space behind the counter electrode (26). Therefore, diffused components of the ions are generated in the space (S1), in which diffusion charging occurs. As a result, efficiency of diffusion charging improves.

According to the thirteenth aspect of the present invention, electric force lines which curve and reach the space behind the counter electrode (26) are generated as well, as in the twelfth aspect of the present invention. Therefore, diffused components of the ions are generated in the space (S2), in which diffusion charging occurs. As a result, efficiency of diffusion charging improves.

According to the fourteenth aspect of the present invention, the counter electrode (26) of the second charge section (20*b*) is located in an air flow path along which the air to be handled flows. Thus, ions which have been emitted from the discharge electrode (25) of the second charge section (20*b*) and which are supposed to be injected to the counter electrode (26) are affected by the air flow, and are diffused in the air without being incident into the counter electrode (26). This means that a proportion of diffused components increases, and as a result, efficiency of diffusion charging improves.

According to the fifteenth aspect of the present invention, if the current flowing in the counter electrode (26) is smaller than the current flowing in the discharge electrode (25), a difference between the current flowing in the counter electrode (26) and the current flowing in the discharge electrode (25) is a diffusion charging current (I1-I2) at the second charge section (20*b*). If there is a current flowing in the counter electrode (26), that current is an impact charging current (I2) at the first charge section (20*a*). In other words, the existence of these two types of currents means that the impact charging and the diffusion charging are occurring at the same time.

According to the sixteenth aspect of the present invention, a proportion of the diffusion charging current is 5% or more and 60% or less of an overall electric current; according to the seventeenth aspect of the present invention, the proportion of the same is 10% or more and 30% or less of the overall electric current; and according to the eighteenth aspect of the present invention, the proportion of the same is 15% or more and 30% or less of the overall electric current. This means that the impact charging technique and the diffusion charging technique can be effectively used. In other words, charged ions can be diffused in sufficient amounts, and therefore, particles of submicron-order (less than 1 μm) can be efficiently charged.

According to the nineteenth aspect of the present invention, an air handling device adopts both of the impact charging technique and the diffusion charging technique. Therefore, floating particles in the air, such as dust, ranging from micron-order (1 μm or more) to submicron-order (less than 1 μm) can be efficiently charged and captured. Further, the use of both of the impact charging technique and the diffusion charging technique enables completion of charging of dust or the like within the casing of the device, and in addition, the device size can be reduced.

According to the twentieth aspect of the present invention, the charging process includes a first charging process adopting an impact charging technique and a second charging process adopting a diffusion charging technique. Since both of the diffusion charging technique and the impact charging technique are used, it is possible to reduce a space necessary for charging the floating particles in the diffusion charging process. Further, since the space for the diffusion charging can be reduced, it is possible to complete the charging of the floating particles, such as dust, in the casing of the device using this method. Moreover, in general, one of the characteristics of the impact charging technique is that floating particles of micron-order tend to be charged in the impact charging technique, and one of the characteristics of the diffusion charging technique is that floating particles of submicron-order tend to be charged in the diffusion charging technique. Thus, particles in a wider range of particle size can be charged, compared to the case where only the impact charging technique or only the diffusion charging technique is used.

According to the twenty-first aspect of the present invention, the air handling method includes both of the impact charging technique and the diffusion charging technique. Therefore, floating particles in the air, such as dust, ranging from micron-order to submicron-order, can be efficiently charged and captured. Further, since both of the impact charging technique and the diffusion charging technique are used, it is possible to complete the charging of the floating particles, such as dust, in the casing of the device using this method. In addition, the device size can be reduced.

BRIEF DESCRIPTION OF THE DRAWINGS

FIG. 9 is a table showing data at the measurement points in FIG. 8.

FIG. 15 shows an example arrangement of a discharge electrode and a counter electrode.

FIG. 16(A) is a graph showing a relationship between a distance between electrodes and the dust collection efficiency, in the electrode arrangements shown in FIG. 14 and FIG. 15. FIG. 16(B) is a graph showing a relationship between a proportion of a diffusion charging current and the dust collection efficiency, in the electrode arrangements shown in FIG. 14 and FIG. 15.

FIG. 22 shows side views of schematic structures of a charge section according to other embodiments.

FIG. 27 shows oblique views according to a variation in which a sawtooth discharge electrode is asymmetric.

FIG. 28 shows outline drawings for illustrating shapes of a discharge section of a discharge electrode.

FIG. 29 shows an oblique view of a discharge electrode according to a variation.

DESCRIPTION OF REFERENCE CHARACTERS

1 Charging Device

10 Air Handling Device

20 Charge section

20*a* First Charge section

20*b* Second Charge section

25 Discharge Electrode

25*a* Upstream Discharge Section (First Discharge Section)

25*b* Downstream Discharge Section (Second Discharge Section)

26 Counter Electrode

26*a* Counter Electrode

26*b* Counter Electrode

30 Electrostatic Precipitator

S1 Space

DESCRIPTION OF EMBODIMENTS

Embodiments of the present invention will be described in detail hereinafter, with reference to the drawings.

<<First Embodiment of Invention>>

Figure 1:
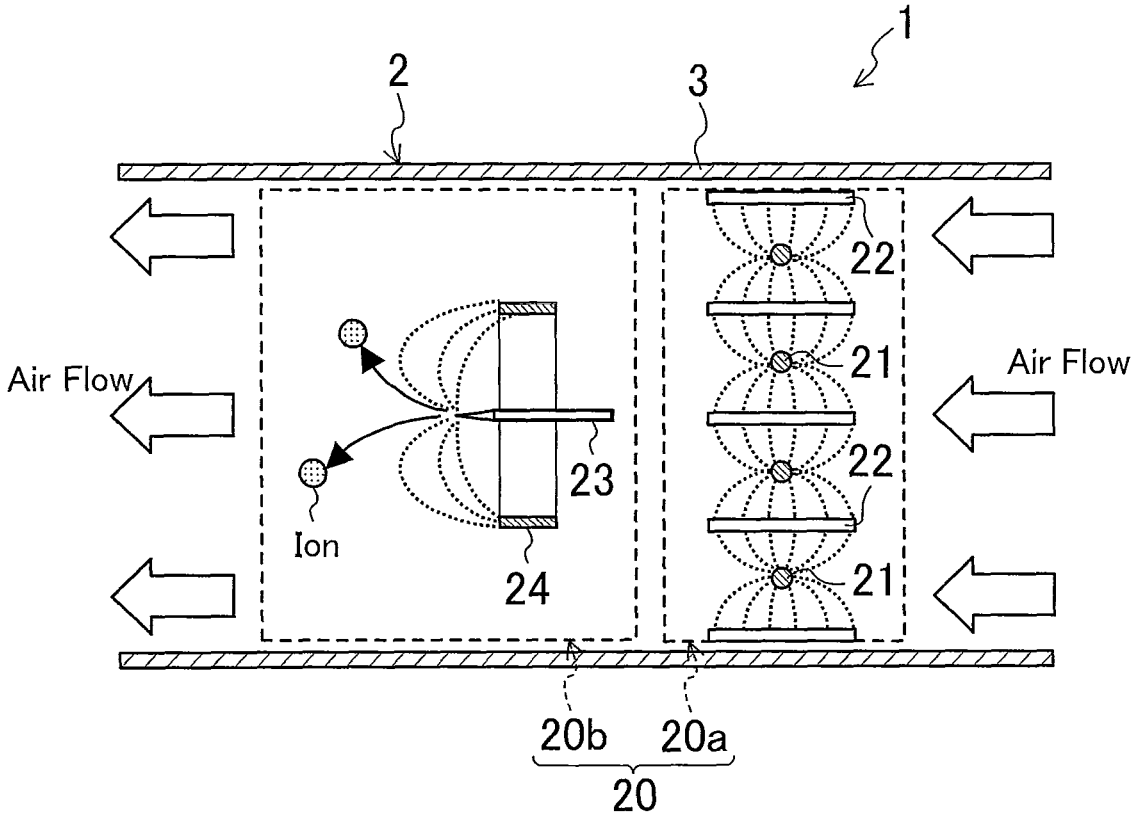
FIG. 1 shows a schematic diagram of a charging device according to the first embodiment of the present invention.

A charging device according to the first embodiment of the present invention will be described. FIG. 1 shows a schematic diagram of a charging device (1). As shown in FIG. 1, the charging device (1) includes a charge section (20) for charging floating particles in the air to be handled. The charging device (1) is constituted by a duct (or a casing) (2) through which the air to be handled flows, and the charge section (20) located in the duct (2). The charge section (20) includes a first charge section (20*a*) adopting an impact charging technique and a second charge section (20*b*) adopting a diffusion charging technique. The first charge section (20*a*) and the second charge section (20*b*) are separate from each other.

The first charge section (20*a*) includes plate-like first counter electrodes (22) arranged parallel to side plates (or top and bottom plates) (3) of the duct (2) at regular intervals, and a wire-like (i.e., linear) first discharge electrode (21) (an ionizing wire) positioned between the first counter electrodes (22) and arranged parallel to and equal distances from the first counter electrodes (22). A high voltage power supply (not shown) is connected to the first discharge electrode (21) and the first counter electrodes (22). In the first charge section (20*a*), ions are emitted from the first discharge electrode (21) to the first counter electrodes (22), and most of the emitted ions reach the first counter electrodes (22). Ions gather in an area between the first discharge electrode (21) and the first counter electrodes (22). Floating particles in the air, such as dust, are charged when the air to be handled passes through this area. The impact charging technique adopted in the first charge section (20*a*) is a charging technique in which ions emitted from the first discharge electrode (21) reach the first counter electrodes (22), generally along the electric force lines shown in dotted lines in FIG. 1.

The second charge section (20*b*) includes a needle-like second discharge electrode (23) and a cylindrical second counter electrode (24) located around the second discharge electrode (23). A front end surface of the second counter electrode (24) is positioned closer to the trailing end of the second discharge electrode (23) than the leading end of the second discharge electrode (23). In the second charge section (20*b*) as well, the second discharge electrode (23) and the second counter electrode (24) is connected to a high voltage power supply (not shown). In the second charge section (20*b*), most of the ions emitted from the second discharge electrode (23) does not reach the second counter electrode (24) and is released in the air, because the curvature of electric force lines generated by the second discharge electrode (23) and the second counter electrode (24) is large, and because the direction of air flow is opposite to the direction of injection of the ions into the second counter electrode (24). The air to be handled passes through the area where ions are dispersed and floating, and thereby, the air is charged. The diffusion charging technique adopted in the second charge section (20*b*) is a charging technique in which ions emitted from the second discharge electrode (23) generally deviate from the electric force lines as ions flow, and in which most of the ions does not reach the second counter electrode (24).

—Operational Behavior—

According to the present embodiment, the charge section (20) is configured by combining the first charge section (20*a*) adopting the impact charging technique in which ions emitted from the first discharge electrode (21) travel along the electric force lines and reach the first counter electrodes (22), and the second charge section (20*b*) adopting the diffusion charging technique in which ions emitted from the second discharge electrode (23) deviate from the electric force lines and are released in the air, in the charging device (1) for charging floating particles in the air to be handled.

Thus, in the charging device (1), a first charging process which adopts the impact charging technique and a second charging process which adopts the diffusion charging technique are performed as a charging process of a method for charging floating particles in the air to be handled.

Here, one of the characteristics of the impact charging technique is that floating particles of micron-order (1 μm or more) tend to be charged by the impact charging technique, and one of the characteristics of the diffusion charging technique is that floating particles of submicron-order (less than 1 μm) tend to be charged by the diffusion charging technique. Thus, according to the present embodiment, floating particles of micron-order (1 μm or more) are effectively charged in the first charge section (20*a*) adopting the impact charging technique, and floating particles of submicron-order (less than 1 μm) are effectively charged in the second charge section (20*b*) adopting the diffusion charging technique.

—Effects of First Embodiment—

As described above, according to the present embodiment, the charge section (20) is constituted by the first charge section (20*a*) adopting the impact charging technique and the second charge section (20*b*) adopting the diffusion charging technique. Therefore, it is possible to charge floating particles in the air, ranging from relatively small particles of submicron-order to relatively large particles of micron-order. This means that the size of floating particles which can be charged is not limited to a certain size range, and therefore, charging capabilities of the device improves.

Further, according to the charging device (1), floating particles such as dust are not ionized in a room, but are ionized in the duct (2). Therefore, the floating particles can be collected in the duct (2). It is thus possible to prevent the floating particles, such as dust, from adhering to the walls or others of the room.

Further, according to the charging device (1), not only the second charge section (20*b*) adopting the diffusion charging technique, but also the first charge section (20*a*) adopting the impact charging technique are used. Therefore, unlike the situation where only the diffusion charging technique is used, which means a large space is necessary and the size of the device is increased, the size of the device (10) as a whole can be reduced.

—Variation of First Embodiment—

The structures of the discharge electrodes (21, 23) and the counter electrodes (22, 24) of the first charge section (20*a*) adopting the impact charging technique and the second charge section (20*b*) adopting the diffusion charging technique may be changed. For example, although the first charge section (20*a*) is constituted by the linear first discharge electrode (21) and the plate-like first counter electrodes (22) in the first embodiment, the first discharge electrode (21) may have a needle-like shape or other shapes. Although the second charge section (20*b*) is constituted by the needle-like second discharge electrode (23) and the cylindrical second counter electrode (24), the shapes of the second discharge electrode (23) and the second counter electrode (24) may be changed appropriately as long as the direction of ion emission from the second discharge electrode (23) and the orientation of the electric force lines are shifted from each other.

<<Second Embodiment of Invention>>

The second embodiment of the present invention will be described.

Figure 2:
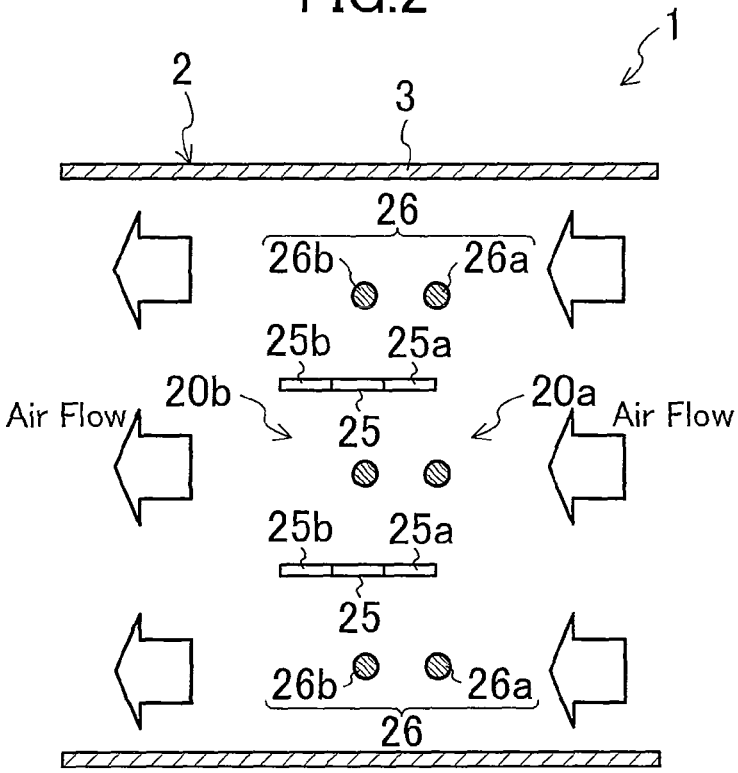
FIG. 2 shows a schematic diagram of a charging device according to the second embodiment.

According to the second embodiment of the present invention, the structure of the charge section (20) of the charging device (1), in which particles suspended in the air to be handled are charged in the duct (2), is different from the structure of the charge section (20) according to the first embodiment, as shown in FIG. 2. According to this embodiment, thin, plate-like discharge electrodes (25) are arranged parallel to side plates (or top and bottom plates) (3) of the duct (casing) (2), and a rod-like counter electrodes (26) are positioned between the discharge electrodes (25) so as to be parallel to each discharge electrode (25).

Figure 3:
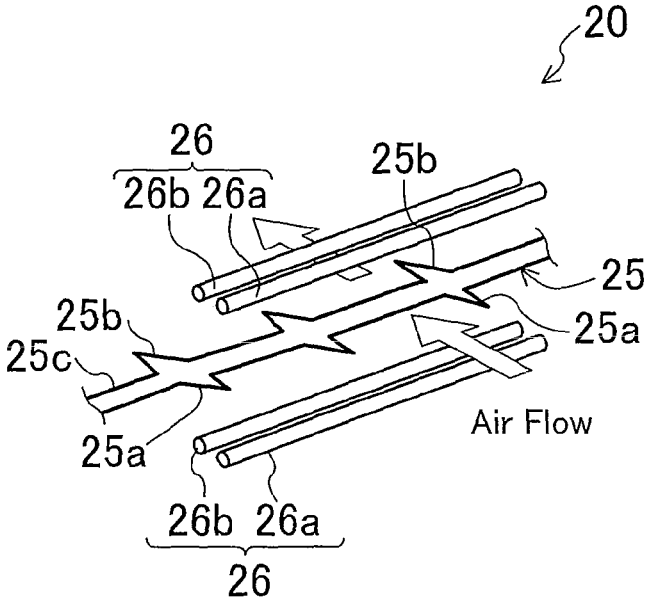
FIG. 3 shows an oblique view of a concrete structure of the charging device according to the second embodiment.
Figure 4:
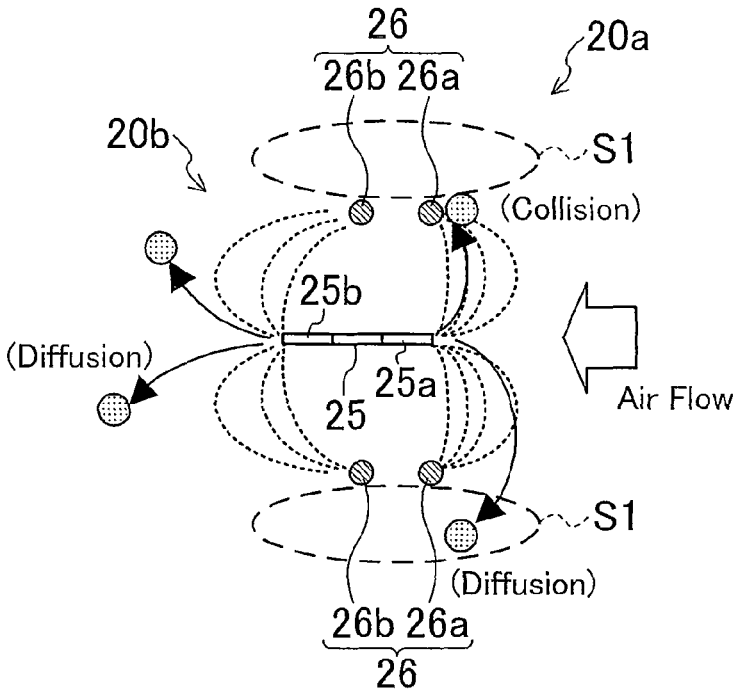
FIG. 4 shows a side view of a concrete structure of the charging device according to the second embodiment.

A structure of the charge section (20) is shown in FIGS. 3 and 4. The discharge electrode (25) is a strip-like member having, at both edges thereof, triangular projections (25*a*, 25*b*) whose tip has an acute angle (the tip may be rounded with a small radius) and which are located at generally regular intervals along a band-like base plate portion (25*c*). These projections (25*a*, 25*b*) constitute a discharge section. As described, according to the second embodiment, the discharge electrode (25) provided at the charge section (20) is a sawtooth electrode. The discharge electrode (25) is integrally formed by an upstream discharge section (25*a*) (a discharge electrode (25) of a first charge section (20*a*), described later) located on the upstream side of an air flow, and a downstream discharge section (25*b*) (a discharge electrode (25) of a second charge section (20*b*), described later) located on the downstream side of the air flow. In the present invention, the term "sawtooth electrode" refers to a plate-like electrode of which the band-like member has generally triangular, or sharp-tipped, plate-like projections provided at predetermined intervals along at least one edge of the band-like member. In the present embodiment, the sawtooth electrode includes triangular, plate-like projections provided symmetrically.

Counter electrodes (upstream counter electrodes) (26*a*) located on the upstream side of an air flow are arranged parallel to the discharge electrode (25), along a vertically-extending phantom plane which passes through the tip, or an area close to the tip of the upstream discharge section (25*a*). Counter electrodes (downstream counter electrodes) (26*b*) located on the downstream side of an air flow are arranged parallel to the discharge electrode (25), along a vertically-extending phantom plane which passes through a center line, or an area close to the center line of the discharge electrode (25).

The upstream discharge section (25*a*) and the upstream counter electrodes (26*a*) constitute a first charge section (20*a*) adopting an impact charging technique. The downstream discharge section (25*b*) and the downstream counter electrodes (26*b*) constitute a second charge section (20*b*) adopting a diffusion charging technique. That is, if described with reference to the direction of flow of the air to be handled, the first charge section (20*a*) is positioned on the upstream side of the air flow, and the second charge section (20*b*) is positioned on the downstream side of the air flow. This means that the counter electrodes (26*a*) of the first charge section (20*a*) are located on the air flow upstream side, and the counter electrodes (26*b*) of the second charge section (20*b*) are located on the air flow downstream side, relative to the discharge electrode (25).

In this structure, the entire charge section (20) including the counter electrodes (upstream counter electrodes) (26*a*) of the first charge section (20*a*) and the counter electrodes (downstream counter electrodes) (26*b*) of the second charge section (20*b*), is located in an air flow path along which the air to be handled flows. It is preferable that at least the counter electrodes (26) of the second charge section (20*b*) are located in an air flow path through which the air to be handled passes.

In the first charge section (20*a*), the upstream discharge section (25*a*) and the upstream counter electrodes (26*a*) are located generally along the same plane, and therefore, the degree of curvature of the electric force lines generated by the upstream discharge section (25*a*) and the upstream counter electrodes (26*a*) is small. In contrast, in the second charge section (20*b*), the downstream counter electrodes (26*b*) are positioned at locations shifted from the direction of ion emission from the downstream discharge section (25*b*), and thus, the degree of curvature of the electric force lines generated by the downstream discharge section (25*b*) and the downstream counter electrodes (26*b*) is large.

—Operational Behavior—

According to the present embodiment, ions emitted from the upstream discharge section (25*a*) to the upstream counter electrodes (26*a*) travel generally along the electric force lines, and collide with the upstream counter electrodes (26*a*). This allows discharge to occur on the air flow upstream side, using an impact charging technique in which density of ions is high. On the other hand, most of the ions emitted from the downstream discharge section (25*b*) to the downstream counter electrodes (26*b*) does not reach the downstream counter electrodes (26*b*) and is released in the air due to the large curvature of the electric force lines and the flow of air from the upstream side to the downstream side. This allows discharge to occur on the air flow downstream side, using a diffusion charging technique in which ions are diffused in the air.

—Effects of Second Embodiment—

In the second embodiment as well, the charge section (20) adopts both of an impact charging technique and a diffusion charging technique. Since floating particles of micron-order tend to be charged by the impact charging technique and floating particles of submicron-order tend to be charged by the diffusion charging technique, it is possible to charge floating particles in the air, ranging from small particles of submicron-order to large particles of micron-order. As a result, charging capabilities of the device improves.

In addition, in the charging device (1) according to the second embodiment as well, floating particles such as dust are not ionized in a room, but are ionized in the duct or the casing (2). Therefore, it is possible to prevent dust or the like from adhering to the walls or others of the room.

Moreover, not only the charge section (20) adopting a diffusion charging technique, but also the charge section (20) adopting an impact charging technique are used. Therefore, the size of the device (10) can be reduced.

Figure 5:
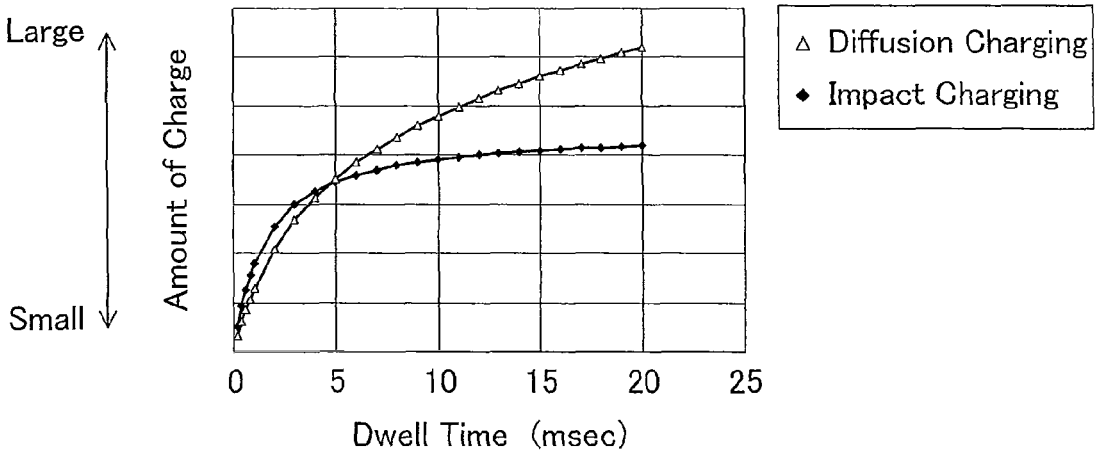
FIG. 5 is a graph showing a relationship between the dwell time of ions in the air and the amount of charge.

Further, as shown in the graph in FIG. 5, if the charging time is short, the amount of charge by the impact charging technique is larger than the amount of charge by the diffusion charging technique. In contrast, if the charging time is long, the amount of charge by the diffusion charging technique is larger than the amount of charge by the impact charging technique. Therefore, the amount of charge is larger when the air to be handled passes through the first charge section (20*a*) and then the second charge section (20*b*), than when the air to be handled passes the second charge section (20*b*) and then the first charge section (20*a*). Based on this theory, the first charge section (20*a*) is located on the upstream side of the flow of air to be handled, and the second charge section (20*b*) is located on the downstream side of the flow of the air to be handled, according to the present embodiment. Thus, floating particles in the air to be handled can be charged adequately.

—Variations of Second Embodiment—

(First Variation)

Figure 6:
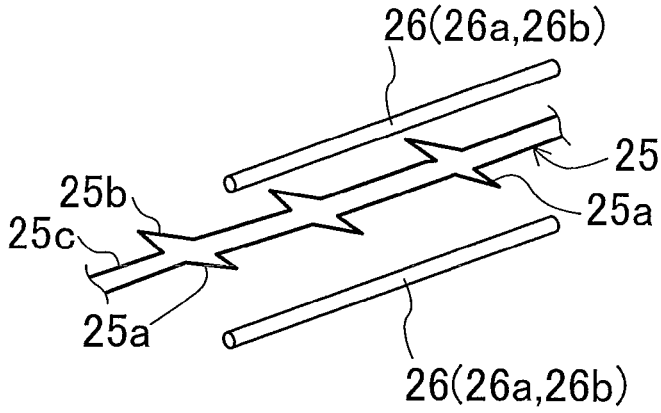
FIG. 6 shows a charge section according to the first variation of the second embodiment.

According to the first variation of the second embodiment, the counter electrode (26*a*) of the first charge section (20*a*) and the counter electrode (26*b*) of the second charge section (20*b*) are integrally formed with each other as shown in FIG. 6, in the structure using, as the discharge electrode (25), a sawtooth electrode (an integral discharge electrode (25)) of which the band-like base plate portion (25*c*) is provided with an upstream discharge section (25*a*) (a first discharge section (25*a*)) constituting the first charge section (20*a*), and a downstream discharge section (25*b*) (a second discharge section 25*b*)) constituting the second charge section (20*b*). Specifically, the counter electrodes (26) are constituted by two rod-like, or columnar electrodes (26) arranged one above the other to sandwich the sawtooth discharge electrode (25) in a vertical direction. The counter electrodes (26) are arranged parallel to the discharge electrode (25) along a vertically-extending phantom plane which passes through the tip, or an area closed to the tip of the upstream discharge section (25*a*). In this structure, the counter electrodes (26) are positioned at locations which are closer to the first discharge section (25*a*) than to the second discharge section (25*b*). Specifically, the structure is similar to the structure shown in FIG. 3 except that one counter electrode is positioned at a location where the upstream counter electrode (26*a*) is positioned in FIG. 3.

Figure 7:
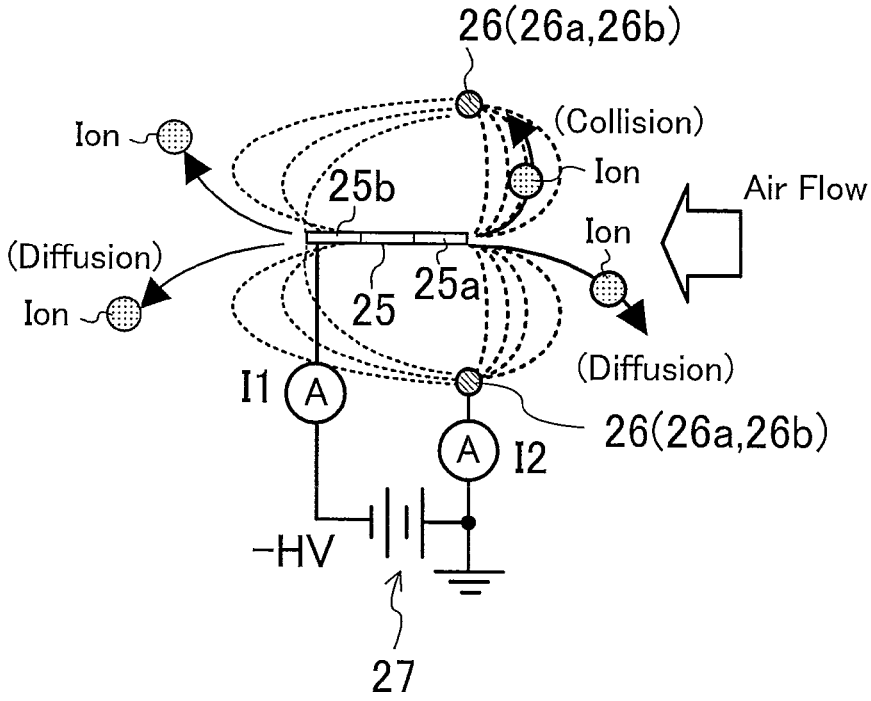
FIG. 7 shows an electric circuit diagram in which a power supply is connected to the charge section shown in FIG. 6.

In this structure as well, the degree of curvature of the electric force lines between the discharge electrode (25) and counter electrodes (26) in the second charge section (20*b*) is larger than the degree of curvature of the electric force lines between the discharge electrode (25) and the counter electrodes (26) in the first charge section (20*a*) (see FIG. 7). Therefore, impact charging occurs in the first charge section (20*a*), whereas diffusion charging occurs in the second charge section (20*b*).

Accordingly, the same effects as in the above-described embodiments can be obtained even if the structure described in this variation is utilized.

In the first variation, a negative pole of a power supply (27) is connected to the discharge electrode (25), and a positive pole of the power supply (27) is connected to the counter electrodes (26) as shown in FIG. 7. The positive side of the power supply (27) is grounded.

Here, if the electric current flowing in the discharge electrode (25) is represented by "I1" and the electric current flowing in the counter electrodes (26) is represented by "I2," both the impact charging current (I2) and the diffusion charging current (I1-I2) flow in the both electrodes. The proportion of the diffusion charging current is set to 5% or more and 60% or less of the overall electric current.

Flow of both of the impact charging current and the diffusion charging current means that both of the impact charging and the diffusion charging occur. Setting the proportion of the diffusion charging current to a value in the above range enables efficient charging of the dust in the air.

Figure 8:
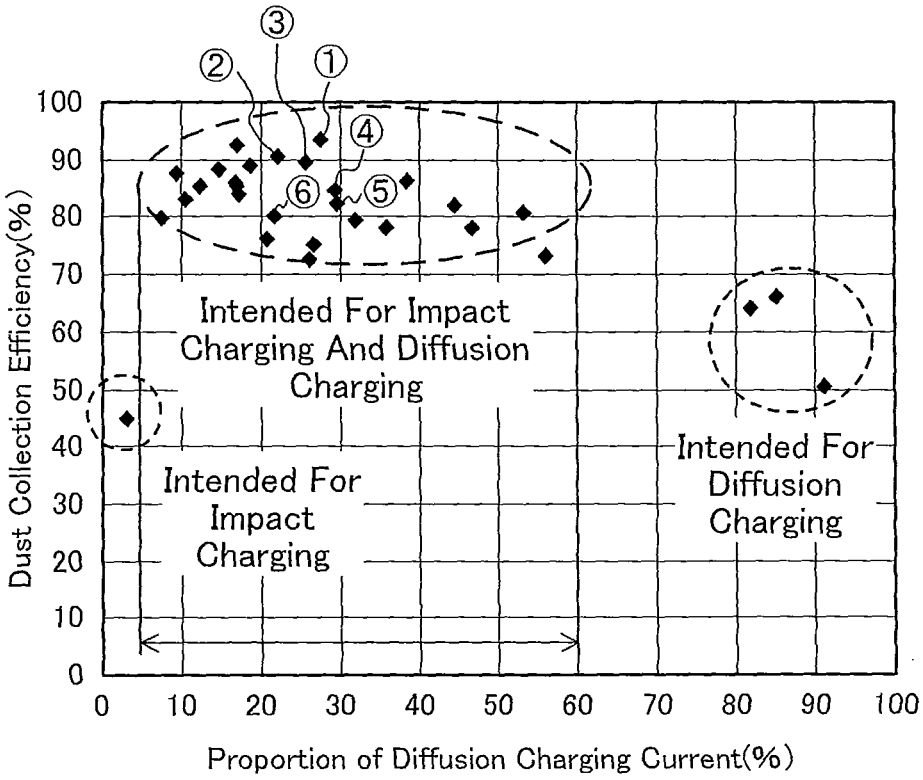
FIG. 8 is a graph showing a relationship between a proportion of a diffusion charging current and the dust collection efficiency.

The range of values described above is determined based on the graph shown in FIG. 8. That is, if the proportion of the diffusion charging current is set to a range of from 5% to 60% of the overall current, the dust collection efficiency can be as high as about 70% to 95% as shown in FIG. 8. The above proportion is preferably from 10% to 30%, and more preferably from 15% to 30%. In contrast, if the proportion of the above current is less than 5%, almost only impact charging occurs, and therefore, the dust collection efficiency is only about 45%. Conversely, if the proportion of the above current exceeds 60%, almost only diffusion charging occurs, and therefore, the dust collection efficiency is only from about 50% to about less than 70%.

Here, a structure of the electrode that is used in the testing from which the measurement result shown in FIG. 8 was obtained will be briefly described. The circled numbers 1-6 listed in the table shown in FIG. 9 correspond to the measurement points identified by the circled numbers shown in FIG. 8. Each of the circled numbers 1-5 represents the testing in which electrodes having the structure as shown in FIG. 7 are used, and the circled number 6 represents the testing in which electrodes having the structure as shown in FIG. 4 are used.

Here, the table shown in FIG. 9 includes, sequentially from the top, the number of counter electrodes, the diameter of the counter electrode, the distance d between a sawtooth discharge electrode and each of the rod-like counter electrodes, the number of upstream discharge sections (25*a*), and the number of downstream discharge sections (25*b*), for each of the structures of electrodes used in the testing identified by the circled numbers 1-6.

The table shows that the dust collection efficiency is high, that is 80% or more, in each of the structures of electrodes used in the testing identified by the circled numbers 1-6. In addition, the proportion of the diffusion current is from 20% to 30%, which falls within the preferable range described above.

Figure 10:
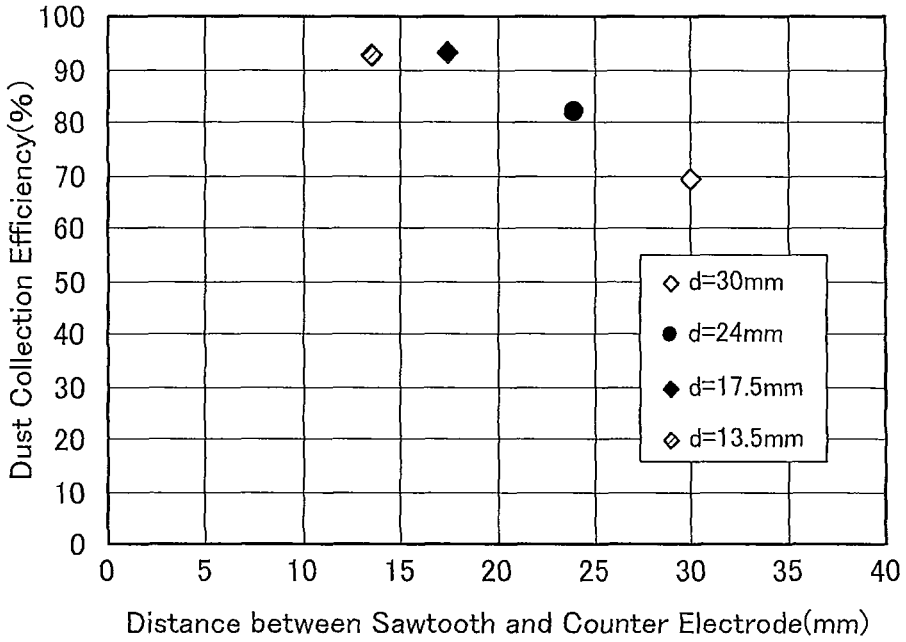
FIG. 10 is a graph showing a relationship between a distance between a discharge electrode and a counter electrode and the dust collection efficiency, in the case where the distance between the electrodes is varied.
Figure 11:
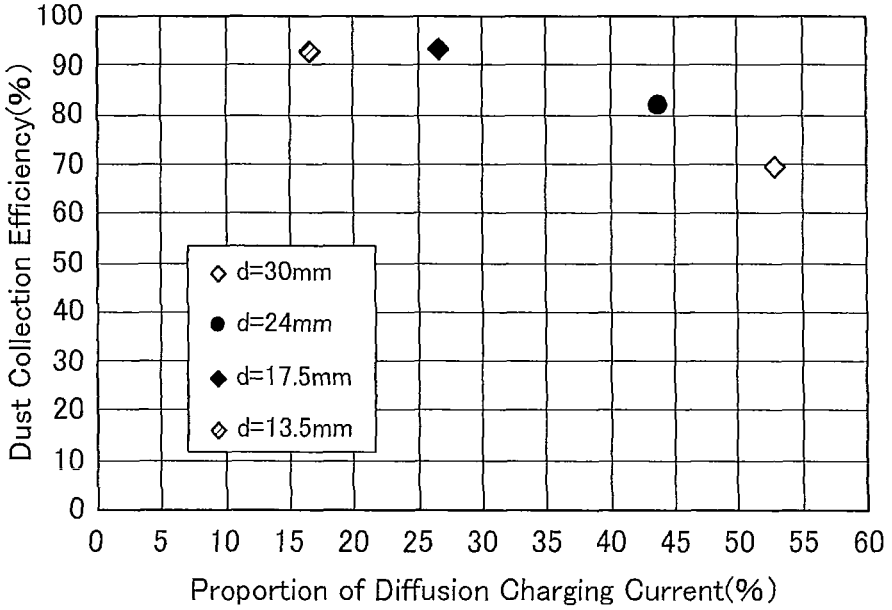
FIG. 11 is a graph showing a relationship between a proportion of a diffusion charging current and the dust collection efficiency, in the case where a distance between a discharge electrode and a counter electrode is varied.

As shown in the graphs in FIGS. 10 and 11, the dust collection efficiencies for cases in which the distance d between the discharge electrode and each of the counter electrodes is different among the cases, were measured. The measurement result shows that the dust collection efficiency is particularly high in the case of d=13.5 mm and d=17.5 mm, and the dust collection efficiency slightly decreases in the case of d=24 mm and d=30 mm However, even in the case of d=24 mm and d=30 mm, the dust collection efficiency is 70% or more, and the percentage is satisfactory in terms of performance of the device. This is because the proportion of the diffusion current is in the range of from 5% to 60% in all cases in which the distance d is varied to measure the dust collection efficiencies, and it is considered that significant effects could be obtained particularly in the case of d=13.5 mm and d=17.5 mm because the proportion of the diffusion current is in the range of from 15% to 30%.

Figure 12:
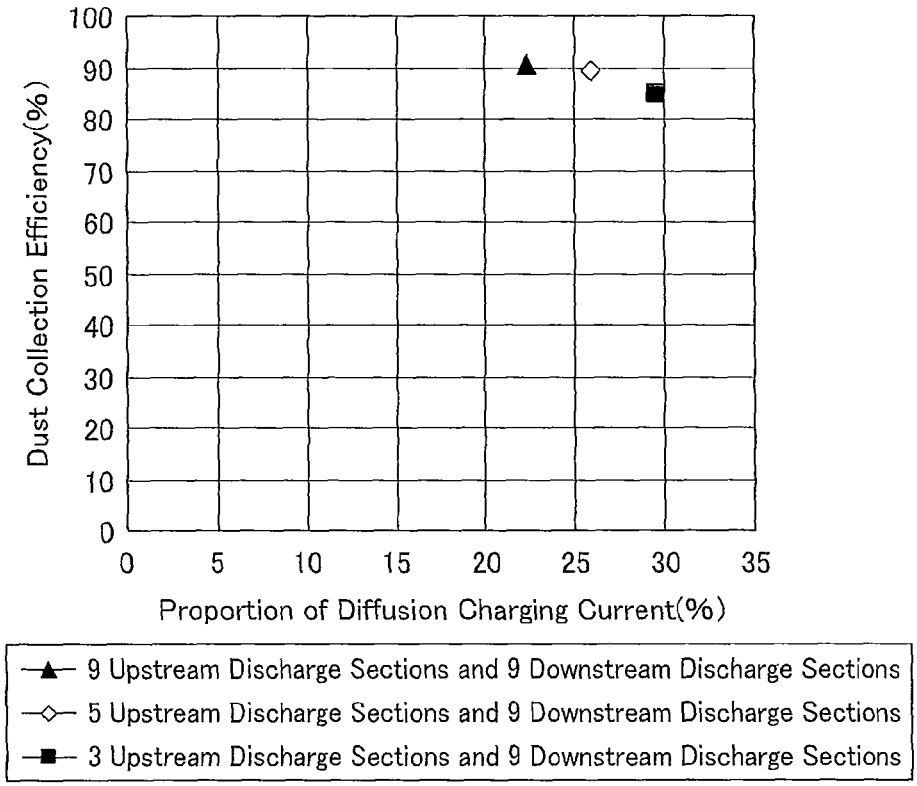
FIG. 12 is a graph showing a relationship between a proportion of a diffusion charging current and the dust collection efficiency, in the case where the number of discharge sections is varied.

Next, the examples identified by the circled numbers 2-4 shown in FIG. 9 are examples in which the number of saw tooth (discharge sections) provided on the upstream side (upstream side of an air flow) and the number of saw tooth (discharge sections) provided on the downstream side (downstream side of an air flow) are different. As shown in the graph in FIG. 12, the proportion of the diffusion charging current increases and the proportion of the impact charging current decreases, as the number of discharge sections on the upstream side of an air flow decreases. However, these data also show that the proportion of the diffusion current is in the range of from 15% to 30% in all cases, and the dust collection efficiency is high, that is 80% or more.

Figure 13:
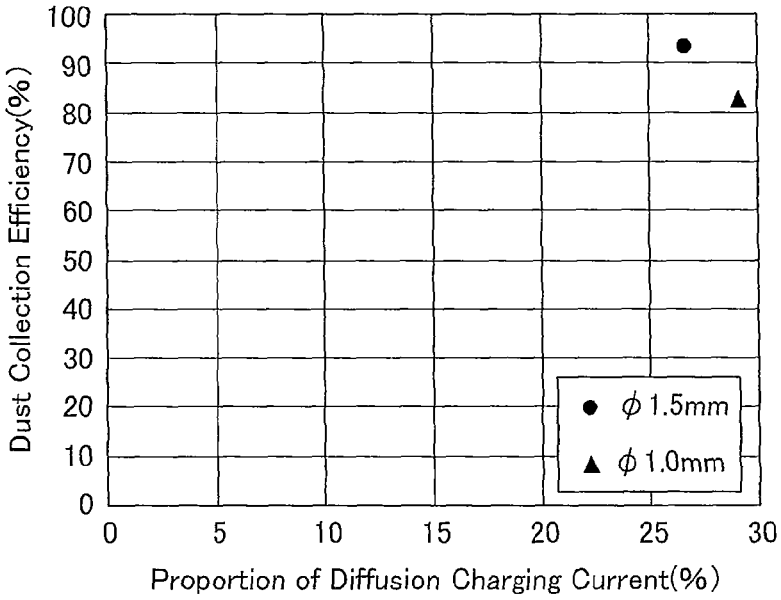
FIG. 13 is a graph showing a relationship between a proportion of a diffusion charging current and the dust collection efficiency, in the case where the diameter of a counter electrode is varied.
Figure 14:
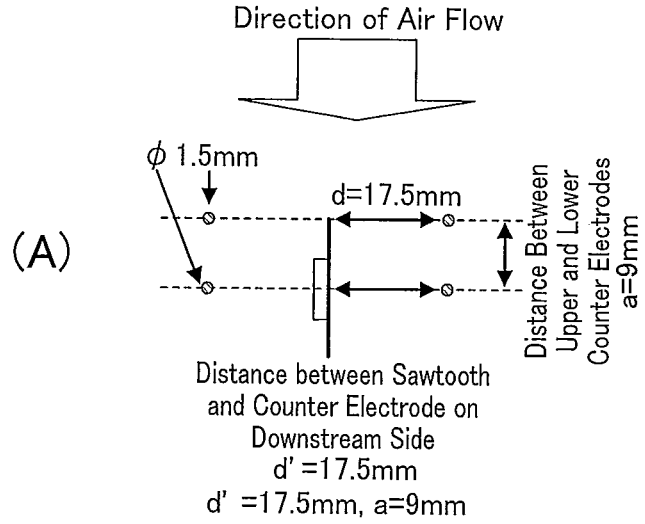
FIG. 14 shows an example arrangement of a discharge electrode and a counter electrode.

The graph shown in FIG. 13 shows data obtained by measuring the dust collection efficiencies for cases in which the diameters of the counter electrodes of the second charge section (20*b*) are different among the cases. The graph shows that the proportion of the diffusion current is higher when the diameter of the counter electrode is smaller. According to the measured values, the diameter ω of each counter electrode (26) of the second charge section (20*b*) are one fifth or less of the distance between the discharge electrode (25) and each of the counter electrodes (26), and the dust collection efficiency is high, that is 80% or more. The dust collection efficiency is higher particularly in the case of ω=1.5 mm, than in the case of ω=1.0 mm FIGS. 14 and 15 show examples in which the arrangement of the counter electrodes relative to the discharge electrode is changed. These examples include examples as shown in FIG. 14 in which the distance d between the discharge electrode and each of counter electrodes on the upstream side of an air flow, and the distance d' between the discharge electrode and each of counter electrodes on the downstream side of an air flow are the same and in which the distance between the upper and lower counter electrodes is varied. The examples also include examples shown in FIG. 15 in which the distance d and the distance d' are different from each other and in which the distance between the upper and lower counter electrodes is varied. FIG. 16 shows the measurement results. As the graph shows, the dust collection efficiency is slightly higher when the distance between the discharge electrode and each of the downstream side counter electrodes is smaller, and the dust collection efficiency is higher when the distance between the upper and lower counter electrodes is smaller. The proportion of the diffusion charging current is in the preferred range described above.

(Second Variation)

Figure 17:
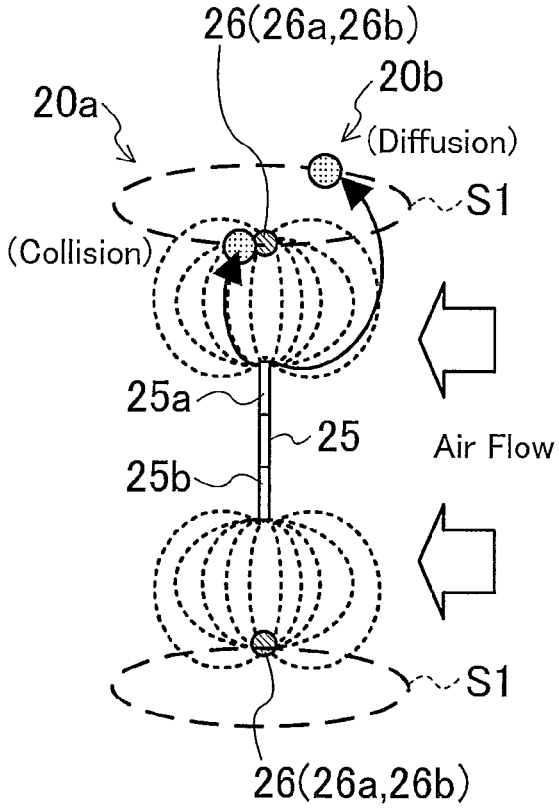
FIG. 17 shows a charge section of the second variation of the second embodiment.

According to the second variation, as shown in FIG. 17, two rod-like counter electrodes (26) are arranged one above the other so as to be parallel to each other, and the discharge electrode (25) (a sawtooth electrode) is placed between the counter electrodes (26), wherein the tip of each of the projections (25*a*, 25*b*) provided at the both edges of the band-like base plate portion (25*c*) is oriented to the corresponding counter electrode (26). In this variation, the first charge section (20*a*) adopting an impact charging technique and the second charge section (20*b*) adopting a diffusion charging technique are formed between the discharge section constituted by the projections (25*a*) located on the upper side and the corresponding counter electrodes (26), using only the discharge section and the counter electrode (26). Further, the first charge section (20*a*) adopting an impact charging technique and the second charge section (20*b*) adopting a diffusion charging technique are also formed between the discharge section constituted by the projections (25*b*) located on the lower side and the corresponding counter electrode (26), using only the discharge section and the counter electrode (26). In the present embodiment, in order to form the first charge section (20*a*) and the second charge section (20*b*) by using only one counter electrode (26) for each discharge section as described above, space (S1) is provided in a region opposite to the discharge electrode (25) relative to the counter electrode (26).

In the above structure, the electric force lines generated between the discharge section (discharge electrode (25)) and each counter electrode (26) include electric force lines having a small degree of curvature which are generated between the discharge electrode (25) and each counter electrode (26), and electric force lines having a large degree of curvature which detour around the space between the discharge electrode (25) and the counter electrode (26) and reach behind the counter electrode (26).

Thus, discharge using an impact charging technique that is caused by a phenomenon in which ions are injected to the counter electrodes (26) along the electric force lines having a small degree of curvature, and discharge using a diffusion charging technique that is caused by a phenomenon in which ions moves away from the electric force lines having a large degree of curvature and are released in the air, occur between the above electrodes. Specifically, ions emitted from the discharge electrode (25) have the property of moving toward the counter electrodes (26) along the electric force lines. However, because the counter electrodes (26), i.e., targets of ions, are small and the air flow affects the movement of the ions, the ions moves away from the electric field and are released in the air, thereby diffusion charging occurs. In addition, the strength of the electric field of the space (S1) behind the counter electrode (26) relative to the discharge electrode (25) is low, and therefore, ions tend to escape into this space (S1).

The same effects as described in the above embodiments can be provided even if the structure described in this variation is utilized, because impact charging and diffusion charging occur as described above. In addition, the structure can be more simplified because the number of counter electrodes (26) can be less than the number of the counter electrodes (26) shown in FIGS. 3 and 4.

(Third Variation)

Figure 18:
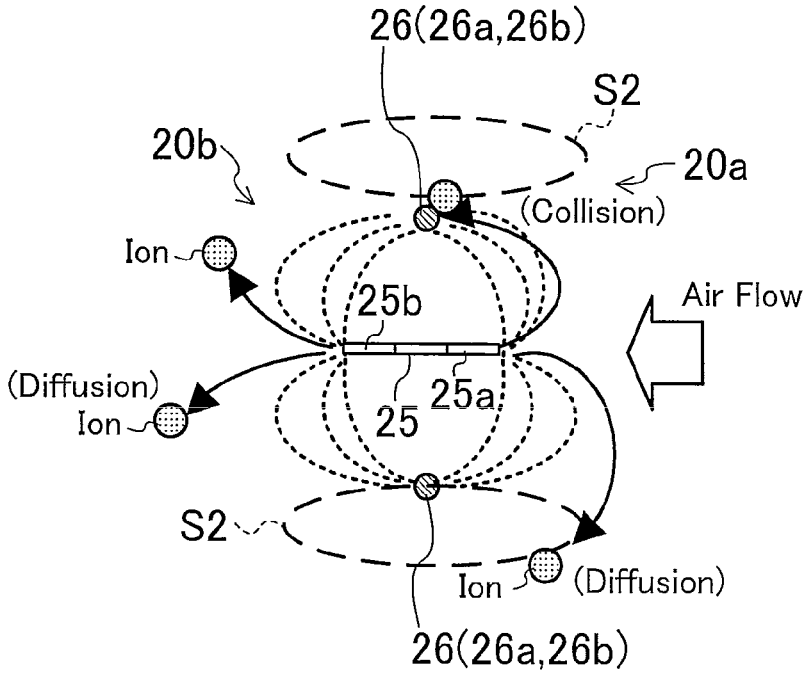
FIG. 18 shows a charge section of the third variation of the second embodiment.

According to the third variation, as shown in FIG. 18, two rod-like counter electrodes (26) are arranged one above the other so as to be parallel to each other, and the discharge electrode (25) (a sawtooth electrode) is placed between the counter electrodes (26), wherein the sawtooth discharge electrode (25) is arranged orthogonal to the phantom plane which connects the two counter electrodes (26). In this variation, the first charge section (20*a*) adopting an impact charging technique and the second charge section (20*b*) adopting a diffusion charging technique are formed between the left and right discharge sections (25*a*, 25*b*) and the counter electrode (26) located above the discharge sections (25*a*, 25*b*), using only the discharge sections (25*a*, 25*b*) and the counter electrode (26). Further, the first charge section (20*a*) adopting an impact charging technique and the second charge section (20*b*) adopting a diffusion charging technique are formed also between the left and right discharge sections (25*a*, 25*b*) and the counter electrode (26) located below the discharge sections (25*a*, 25*b*), using only the discharge sections (25*a*, 25*b*) and the counter electrode (26). In the present embodiment, in order to form the first charge section (20*a*) and the second charge section (20*b*) by using only one counter electrode (26) for each discharge section as described above, space (S2) is provided around the entire periphery of the counter electrode (26).

In the above structure, the electric force lines generated between the discharge section (discharge electrode (25)) and each counter electrode (26) include electric force lines having a small degree of curvature which are generated between the discharge electrode (25) and each counter electrode (26), and electric force lines having a large degree of curvature which detour around the space between the discharge electrode (25) and the counter electrode (26) and reach behind the counter electrode (26).

Thus, discharge using an impact charging technique that is caused by a phenomenon in which ions are injected to the counter electrode (26) along the electric force lines having a small degree of curvature, and discharge using a diffusion charging technique that is caused by a phenomenon in which ions moves away from the electric force lines having a large degree of curvature and are released in the air, occur between the above electrodes.

The same effects as described in the above embodiments can be provided even if the structure described in this variation is utilized, because impact charging and diffusion charging occur as described above. In addition, the structure can be more simplified because the number of counter electrodes (26) can be less than the number of the counter electrodes (26) shown in FIGS. 3 and 4.

(Fourth Variation)

According to the fourth variation, the structure of the discharge electrode (25) differs from the structure of the discharge electrode (25) shown in FIG. 6.

Figure 19:
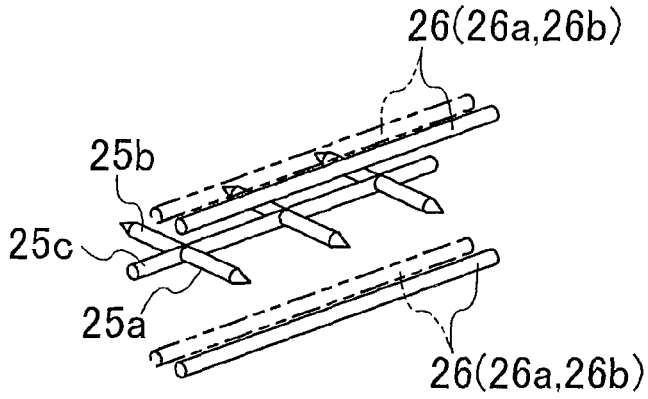
FIG. 19 shows a charge section of the fourth variation of the second embodiment.

Specifically, as shown in FIG. 19, the discharge electrode (25) includes a conductive, rod-like base plate portion (25*c*) and a plurality of sharp-tipped, needle-like discharge sections (25*a*, 25*b*) fixed to the rod-like base plate portion (25*c*). Each of the discharge sections (25*a*, 25*b*) is fixed to the rod-like base plate portion (25*c*) and projects out at a right angle. Further, each discharge section (25*a*, 25*b*) is constituted by a pair of discharge electrodes arranged in alignment with each other, and all the discharge sections (25*a*, 25*b*) are located along one phantom plane. In this example as well, the discharge section on the right side of the drawing is an upstream discharge section (25*a*), and the discharge section on the left side of the drawing is a downstream discharge section (25*b*).

Counter electrodes (26) are arranged one above the other, with the discharge electrode (25) interposed therebetween. The counter electrodes (26) are arranged along a plane which vertically passes through the tips of the upstream discharge sections (25*a*). The counter electrodes (26) are arranged parallel to each other at equal distances from the upstream discharge section (25*a*). Downstream counter electrodes (26*b*) shown in phantom line may be provided as the counter electrodes (26), such that the downstream counter electrodes (26*b*) are arranged one above the other, with the rod-like base portion (25*c*) of the discharge electrode (25) interposed therebetween, and parallel to the rod-like base portion (25*c*). These upper and lower downstream counter electrodes (26*b*) are arranged at equal distances from the rod-like base portion (25*c*) of the discharge electrode (25).

Electric force lines which are generated between the upstream discharge section (25*a*) and the counter electrodes (26) and which have a small degree of curvature, and electric force lines which are generated between the downstream discharge section (25*b*) and the counter electrodes (26) and which have a large degree of curvature, are formed between the discharge sections (25*a*, 25*b*) (a discharge electrode (25)) and the counter electrodes (26) in this structure as well.

Thus, discharge using an impact charging technique that is caused by a phenomenon in which ions are injected to the counter electrode (26) along the electric force lines having a small degree of curvature, and discharge using a diffusion charging technique that is caused by a phenomenon in which ions moves away from the electric force lines having a large degree of curvature and are released in the air, occur between the above electrodes (25, 26). Therefore, the same effects as described in the above embodiments can be provided even if the structure described in this variation is utilized.

<<Third Embodiment>>

The third embodiment of the present invention will be described.

Figure 20:
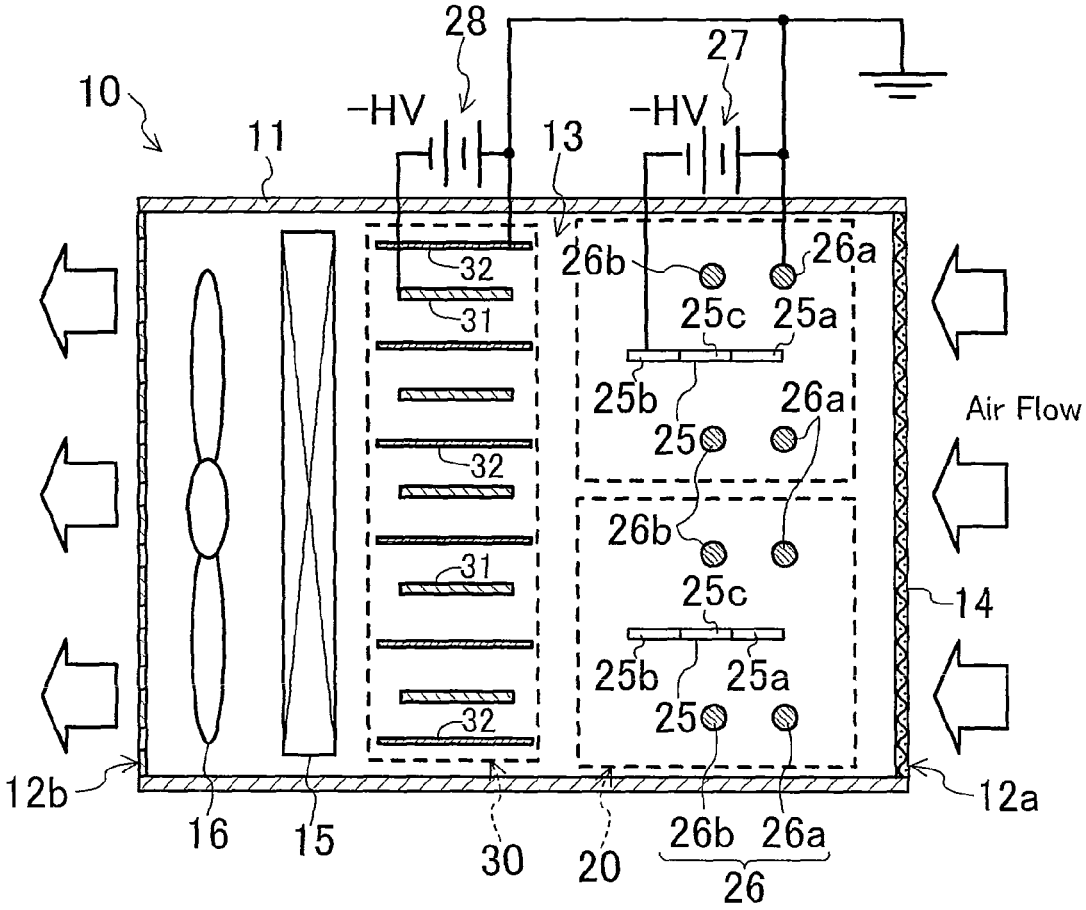
FIG. 20 is a schematic cross sectional view of an interior structure of an air cleaning device according to the third embodiment.

In the third embodiment, the charging device (1) according to the present invention is adopted in an air cleaning device (an air handling device) (10). FIG. 20 is a schematic cross sectional view of an interior structure of the air cleaning device (10).

The air cleaning device (10) has a hollow casing (11) whose shape is a rectangular parallelepiped. A plurality of functional components are accommodated in the casing (11). An air inlet (12*a*) is provided in one wall of the casing (11). An air outlet (12*b*) is provided in the wall facing the air inlet (12*a*). The air inlet (12*a*) is provided with a pre-filter (14) for collecting relatively large dust (floating particles) contained in the air to be handled.

An air flow path (13) through which air flows from the air inlet (12*a*) to the air outlet (12*b*) is formed in the interior of the casing (11). A charge section (20), a precipitator (electrostatic precipitator) (30), an adsorption member (15) and a propeller fan (16) are disposed in the air flow path (13), in this order, from the upstream side to the downstream side of an air flow.

The air cleaning device (10) has two charge sections (20) having the same structure and arranged one above the other. Each charge section (20) is constituted by a discharge electrode (25) and counter electrodes (26) like the charge sections shown in FIGS. 3-5 described in the second embodiment. The discharge electrode (25) is a strip-like electrode arranged parallel to the direction of the air flow, and includes triangular projections (25*a*, 25*b*) whose tip has an acute angle and which are located at generally regular intervals along both edges of a band-like base plate portion (25*c*). These projections (25*a*, 25*b*) form a discharge section. The discharge section (25*a*, 25*b*) includes an upstream discharge section (25*a*) located on the upstream side of an air flow, and a downstream discharge section (25*b*) located on the downstream side of an air flow.

The counter electrodes (26) are rod-like (or columnar) electrodes, and arranged such that the discharge electrode (25) is interposed between two pairs of counter electrodes located above and below the discharge electrode (25). Each pair of counter electrodes (26) includes a counter electrode (an upstream counter electrode) (26*a*) located on the upstream side of an air flow, and a counter electrode (downstream counter electrode) (26*b*) located on the downstream side of the air flow. The upstream counter electrodes (26*a*) are arranged parallel to the discharge electrode (25) along a vertically-extending phantom plane which passes through the tip, or an area close to the tip of the upstream discharge section (25*a*). Further, the downstream counter electrodes (26*b*) are arranged parallel to the discharge electrode (25) along a vertically-extending phantom plane which passes through a center line, or an area close to the center line of the discharge electrode (25).

A negative pole of a direct current high voltage power supply (27) for discharge is connected to the discharge electrode (25), and a positive pole of the power supply (27) is connected to the counter electrodes (26). The positive side of the high voltage power supply (27) is grounded.

The precipitator (30) includes a first electrode (31) to which a negative pole of a direct current high voltage power supply (28) for dust collection is connected, and a second electrode (32) to which a positive pole of the power supply (28) is connected. The positive side of the power supply (28) is grounded. The first electrode (31) and the second electrode (32) may be electrode plates alternately arranged at equal intervals, or the second electrode (32) may be in the form of grid, and the rod-like, or needle-like first electrode (31) is disposed in the small space of each grid cell.

The adsorption member (15), although not shown in detail, is a member which includes a honeycomb base having a lot of small air flow holes along the direction of an air flow, and in which fine powders of an adsorption, such as zeolite which adsorbs odorous components, are carried on the surface of the honeycomb base. Not only an adsorption, but also fine powders of a deodorizing catalyst are carried on the adsorption member (15). If part of odorous components in the air passes through the precipitator (30) without being captured by the precipitator (30), the adsorption member (15) captures the odorous components with the adsorption, and decomposes the odorous components on the surface of the adsorption member (15) by the action of the deodorizing catalyst. Heat catalysts and photocatalysts which are activated by active substances such as heat, light, ozone and so forth generated by the discharge in the charge section (20) and which accelerate the decomposition of the odorous components, can be used as the deodorizing catalyst.

As described above, the air cleaning device (10) includes the charge section (20) for charging dust in the air to be handled, and the precipitator (electrostatic precipitator) (30) for collecting the charged dust. Further, the charge section (20) includes, like the charge section (20) in the first and second embodiments, the first charge section (20*a*) adopting an impact charging technique and the second charge section (20*b*) adopting a diffusion charging technique.

The air cleaning device (10) performs a charging process for charging dust in the air to be handled and an electrostatic precipitation process for electrostatically collecting the charged dust. The charging process includes a first charging process adopting an impact charging technique and a second charging process adopting a diffusion charging technique.

—Operational Behavior—

When the air cleaning device (10) according to the present embodiment is actuated, the propeller fan (16) rotates, and room air, i.e., air to be handled, is drawn into the casing (11) through the air inlet (12*a*). In the charge section (20), a potential difference is established between the discharge electrode (25) and the counter electrodes (26), and ions are emitted from the discharge electrode (25). Most of the ions emitted from the upstream discharge section (25*a*) of the discharge electrode (25) reach the upstream counter electrodes (26*a*), whereas most of the ions emitted from the downstream discharge section (25*b*) does not reach the downstream counter electrodes (26*b*) and is released in the air.

In other words, according to the air cleaning device (10), the air handling method includes a charging process for charging dust in the air to be handled, and an electrostatic precipitation process for electrostatically collecting the charged dust; and the charging process includes a first charging process adopting an impact charging technique and a second charging process adopting a diffusion charging technique.

One of the characteristics of the impact charging technique is that relatively large dust (floating particles) of micron-order (1 μm or more) tend to be charged in the impact charging technique, and one of the characteristics of the diffusion charging technique is that relatively small dust of submicron-order (less than 1 μm) tend to be charged in the diffusion charging technique. The first charge section (20*a*) adopts an impact charging technique, and most of the ions emitted from the upstream discharge section (25*a*) reach the upstream counter electrodes (26*a*). The ions are gathered at an area between the upstream discharge section (25*a*) and the upstream counter electrodes (26*a*). The relatively large dust of micron-order is charged when the air to be handled passes through this area. In contrast, the second charge section (20*b*) adopts a diffusion charging technique, and most of the ions emitted from the downstream discharge section (25*b*) is released in the air. Thus, the ions are dispersed in the air, and the relatively small dust of submicron-order is charged when the air to be handled flows through the space where ions are dispersed.

The air to be handled flows into the precipitator (30), with dust particles, ranging from small particles of submicron-order to large particles of micron-order, being charged. Since the precipitator (30) includes the negatively-charged first electrode (31) and the positively-charged second electrode (32), the ionized dust can be captured by a coulomb force.

The adsorption member (15) carrying a deodorizing catalyst is provided next to the precipitator (30), so that odorous components are removed and decomposed.

After that, the air to be handled from which dust has been removed and in which odorous components have been decomposed, is blown into a room through the air outlet (12*b*).

—Effects of Third Embodiment—

The impact charging technique and the diffusion charging technique are used in the third embodiment as well. Thus, dust particles in the air, ranging from submicron-order to micron-order, can be charged and removed. This can prevent the situation in which the size of the dust particles which can be removed is limited to a certain size range.

Further, the device (10) will increase in size if only the impact charging technique or only the diffusion charging technique is used. However, both the impact charging technique and the diffusion charging technique are used in this embodiment, and therefore, the size of the device (10) can be reduced.

Further, ions are not released in a room, and dust is charged in the casing (11) according to the diffusion charging technique described in this embodiment. It is thus possible to prevent the charged dust from adhering to and soiling the wall of the room.

<<Fourth Embodiment of Invention>>

The fourth embodiment of the present invention will be described.

Figure 21:
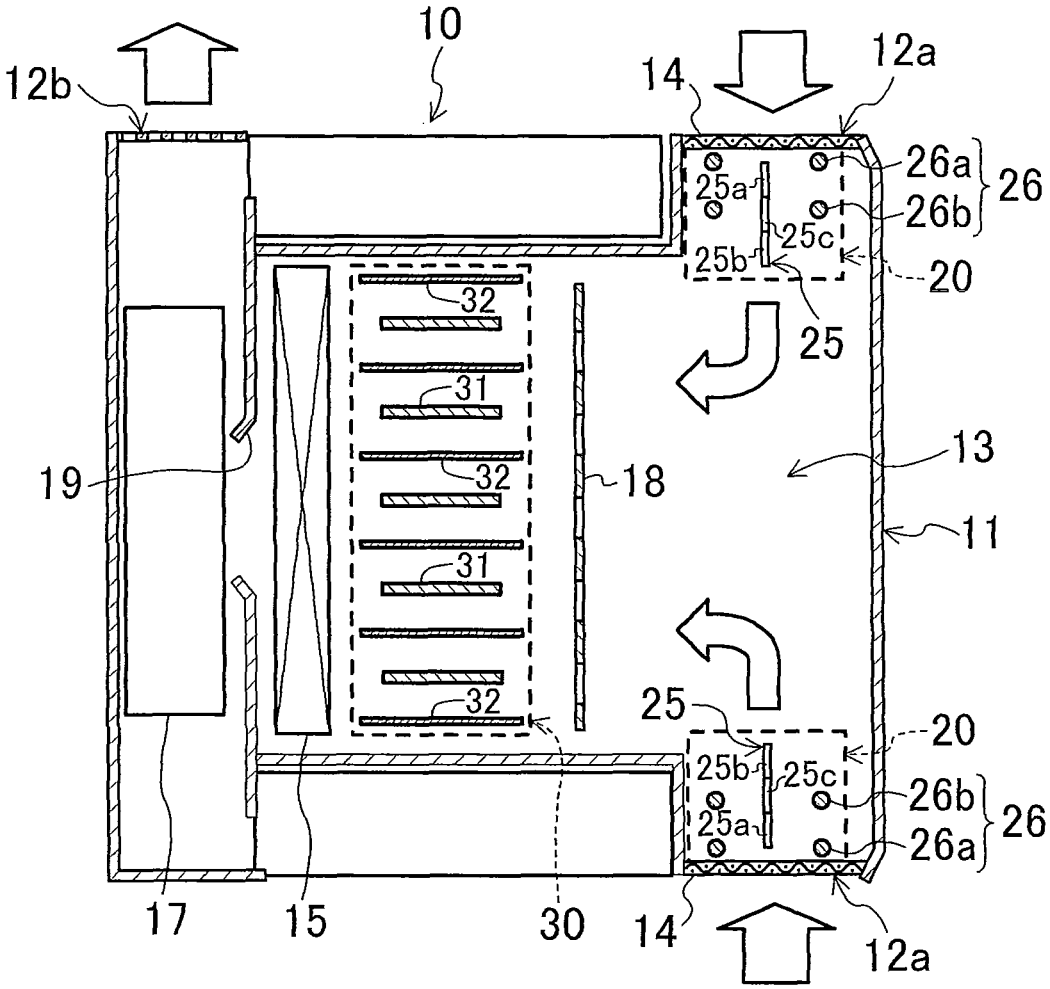
FIG. 21 is a schematic cross sectional view of an interior structure of an air cleaning device according to the fourth embodiment.

In the fourth embodiment, the charging device (1) according to the present invention is adopted in an air cleaning device (an air handling device) (10) as in the case of the third embodiment. However, the structure of the device (10) is different from the structure of the device (10) described in the third embodiment. FIG. 21 is a schematic cross sectional view of an interior structure of the air cleaning device (10).

The air cleaning device (10) includes a hollow casing (11), and a plurality of functional components are accommodated in the casing (11). The casing (11) is provided with air inlets (12*a*) at right end portions of the upper and lower (or left and right) walls as shown in the drawing, and an air outlet (12*b*) at a left end portion of one of the upper and lower (or left and right) walls as shown in the drawing. Each of the air inlets (12*a*) is provided with a pre-filter (14) for capturing relatively large dust (floating particles) contained in the air to be handled.

An air flow path (13) through which air flows from the air inlets (12*a*) to the air outlet (12*b*) is formed in the interior of the casing (11). A charge section (20), a precipitator (30), an adsorption member (15), and a centrifugal fan (a sirrocco fan) (17) are disposed in this order in the air flow path (13) from the upstream side to the downstream side of an air flow. The air flow path (13) extends along the direction of air taken through the air inlets (12*a*) from the upper and lower (or left and right) sides of the casing (11), and is bent into an approximately right angle toward the air outlet (12*b*), and is further bent at the sirrocco fan (17) toward the air outlet (12*b*).

The air cleaning device (10) has two charge sections (20) having the same structure and arranged one above the other. Each charge section (20) is constituted by a discharge electrode (25) and counter electrodes (26) like the charge sections shown in FIGS. 3-5 described in the second embodiment. The discharge electrode (25) is a strip-like electrode arranged parallel to the direction of the air flow, and includes triangular projections (25*a*, 25*b*) whose tip has an acute angle and which are located at generally regular intervals along both edges of a base plate portion (25*c*). These projections (25*a*, 25*b*) form a discharge section. The discharge section (25*a*, 25*b*) includes an upstream discharge section (25*a*) located on the upstream side of an air flow, and a downstream discharge section (25*b*) located on the downstream side of an air flow.

The counter electrodes (26) are rod-like electrodes, and arranged such that the discharge electrode (25) is interposed between two pairs of counter electrodes located in the lateral side areas of the discharge electrode (25). Each pair of counter electrodes (26) includes a counter electrode (an upstream counter electrode) (26*a*) located on the upstream side of an air flow, and a counter electrode (downstream counter electrode) (26*b*) located on the downstream side of the air flow. The upstream counter electrode (26*a*) is arranged parallel to the discharge electrode (25) along a vertically-extending phantom plane which passes through the tip, or an area close to the tip of the upstream discharge section (25*a*). Further, the downstream counter electrodes (26*b*) is arranged parallel to the discharge electrode (25) along a vertically-extending phantom plane which passes through a center line, or an area close to the center line of the discharge electrode (25).

The air flow path (13) is bent at a location through which the air to be handled flows after the air to be handled has passed through the charge section (20). A straightening member (18) is located on the upstream side of the precipitator (30) in the air flow path (13). Further, the precipitator (30) having the same structure as the precipitator (30) in the third embodiment, and an adsorption member (15) carrying an adsorption and a deodorizing catalyst are disposed on the downstream side of the straightening member (18) in the air flow path (13).

A bell mouth (19) is located on the downstream side of the adsorption member (15), for guiding an air flow to the sirrocco fan (17). The sirrocco fan (17) changes the direction of the air guided to the sirrocco fan (17) through the bell mouth (19), and the air is blown out of the casing (11) through the air outlet (12*b*).

In this embodiment, a power supply for the charge section (20) and the precipitator (30) are not shown in the drawings.

—Operational Behavior—

When the air cleaning device (10) according to the present embodiment is actuated, the sirrocco fan (17) starts to rotate, and room air, i.e., air to be handled, is drawn into the casing (11) through the air inlet (12*a*). In the charge section (20), a potential difference is established between the discharge electrode (25) and the counter electrodes (26), and ions are emitted from the discharge electrode (25). Most of the ions emitted from the upstream discharge section (25*a*) of the discharge electrode (25) reach the upstream counter electrodes (26*a*), whereas most of the ions emitted from the downstream discharge section (25*b*) does not reach the downstream counter electrodes (26*b*) and is released in the air. Here, the ions are diffused more effectively owing to the bending of the air flow path (13).

The ions emitted from the upstream discharge section (25*a*) are gathered at an area between the upstream discharge section (25*a*) and the upstream counter electrodes (26*a*). The relatively large dust of micron-order is charged when the air to be handled passes through this area. In contrast, most of the ions emitted from the downstream discharge section (25*b*) is released in the interior space of the casing (11), and dispersed in the interior space. Thus, the relatively small dust of submicron-order is charged when the air to be handled passes through the interior space.

The air to be handled flows into the precipitator (30), with dust particles, ranging from small particles of submicron-order to large particles of micron-order, being charged.

Since the precipitator (30) includes the positively-charged electrode plates (32) and the negatively-charged electrode plates (31), the ionized dust can be captured by a coulomb force.

Most of dust in the air to be handled is removed after the air to be handled passes through the precipitator (30). However, some dust remains and moves toward the air outlet (12*b*) without being captured by the precipitator (30). The dust having passed through the precipitator (30) is captured by the adsorption member (15). The adsorption member (15) carries a deodorizing catalyst, too, and therefore, odorous components are decomposed at the adsorption member (15) as well.

Consequently, the air to be handled from which dust has been removed and in which odorous components have been decomposed is blown into a room through the air outlet (12*b*).

—Effects of Fourth Embodiment—

The impact charging technique and the diffusion charging technique are used in the fourth embodiment as well. Thus, dust particles in the air, ranging from submicron-order to micron-order, can be charged and removed. This can prevent the situation in which the size of dust particles which can be removed is limited to a certain size range.

Further, the device (10) will increase in size if only the impact charging technique or only the diffusion charging technique is used. However, both the impact charging technique and the diffusion charging technique are used in this embodiment, and therefore, the size of the device (10) can be reduced. In addition, the air flow path (13) is bent at a location through which air flows immediately after the air has passed through the charge section (20). Therefore, the ions are diffused more effectively, and high efficiency can be achieved even if the size of the device (10) is reduced.

A diffusion charging technique is used in the present embodiment. However, ions are not released in a room, and dust is charged in the casing (11). Therefore, it is possible to prevent the charged dust from adhering to and soiling the walls of the room.

<<Other Embodiments>>

The present invention may have the following structures in the above embodiments.

Figure 23:
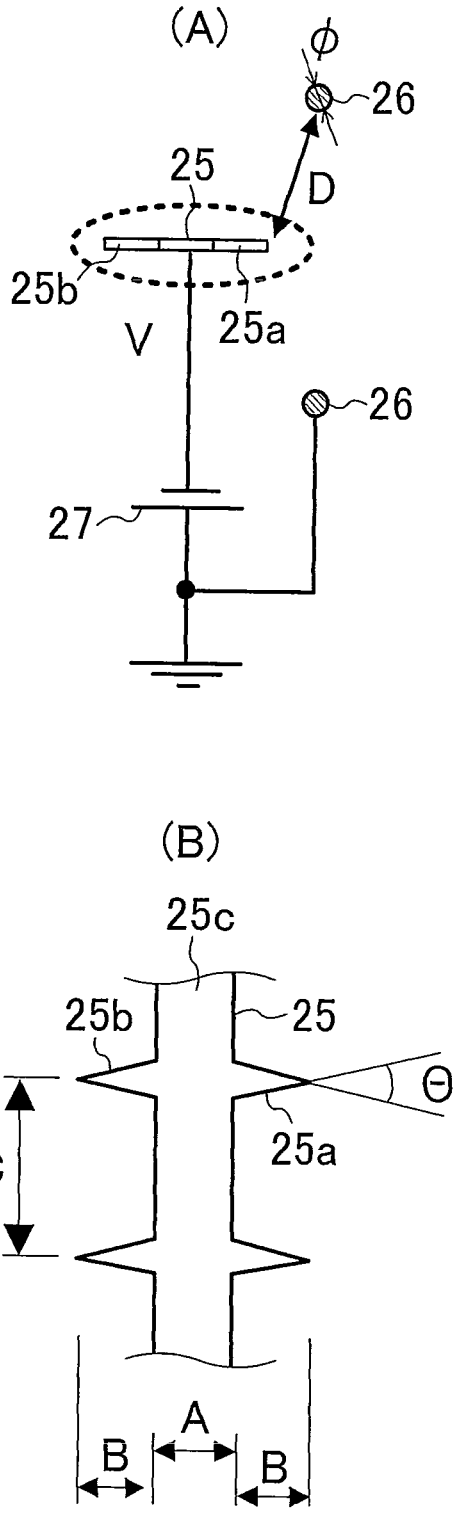
FIG. 23 shows an example dimension of an electrode and a voltage.
Figure 24:
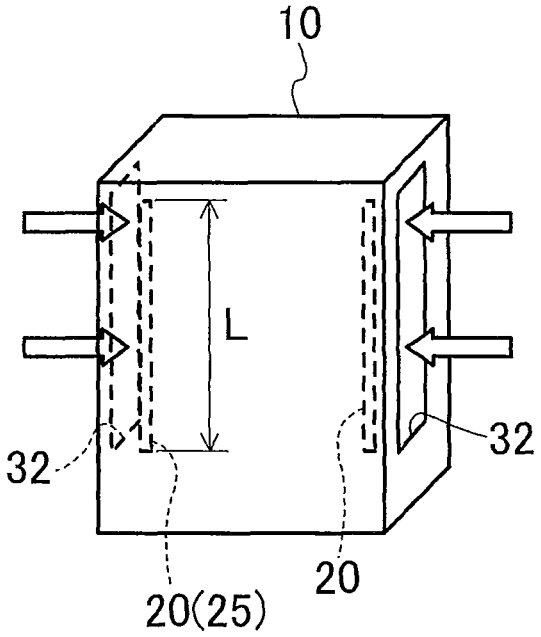
FIG. 24 shows an oblique view of an air cleaning device in which air is drawn from sides of the air cleaning device, according to a variation.

For example, in the structure in which rod-like counter electrodes (26) are arranged one above the other with the sawtooth discharge electrode (25) interposed therebetween, the counter electrodes (26) may be located on the air flow upstream side of the end of the discharge electrode (25) on the air flow upstream side, as shown in FIGS. 22 (A) and 22 (B). Example dimensions of the electrodes and voltages are shown in FIG. 23. In the drawing, the diameter of a counter electrode is represented as "V;" the distance between the end of the upstream discharge section (25*a*) and the counter electrode (26) is represented as "D;" a voltage applied to the discharge electrode is represented as "V;" the thickness of the discharge electrode (25) is represented as "t;" the width of the band-like base plate portion (25*c*) is represented as "A;" the length of each of the discharge sections (25*a*, 25*b*) protruding from the base plate portion (25*c*) is represented as "B;" and the angle of the tip of each discharge section (25*a*, 25*b*) is represented as "θ," and all of these are set to the following values:

$1\ m \leqq \omega \leqq 3\ mm$ $15\ mm \leqq D \leqq 35\ mm$ $-7\ kV \leqq V \leqq -10\ kV$ $10\ \mu m \leqq t \leqq 100\ \mu m$ A=8 mm B=5 mm C=25 mm $10° \leqq \theta \leqq 30°$ FIG. 24 shows an air cleaning device in which air is drawn from sides of the air cleaning device, and "L" representing the length of the discharge electrode (25) in the charge section (20) is set to:

L=300 mm

The impact charging technique and the diffusion charging technique efficiently occur by setting the dimensions as described above. Stainless steel can be used for the both of the discharge electrode (25) and the counter electrodes (26). Other conductive materials can also be used.

Figure 25:
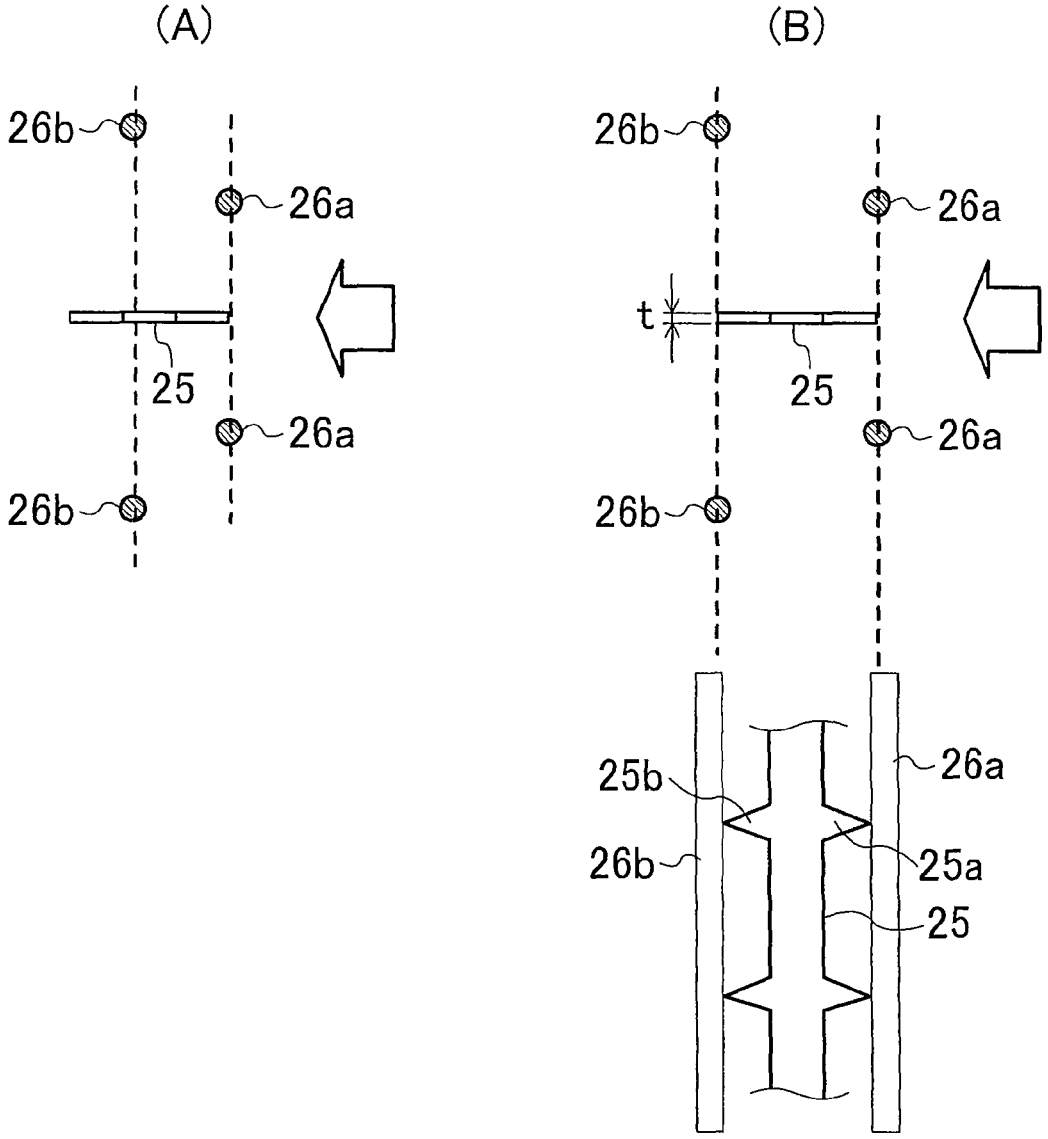
FIG. 25 shows side views of schematic structures of a charge section according to other embodiments.

In the structure in which the sawtooth discharge electrode (25) is interposed between two pairs of rod-like counter electrodes (26*a*, 26*b*) located above and below the discharge electrode (25), the distance between the discharge electrode (25) and the counter electrode (26*b*) of the second charge section (20*b*) may be larger than the distance between the discharge electrode (25) and the counter electrode (26*a*) of the first charge section (20*a*) as shown in FIGS. 25 (A) and 25 (B). If the distance between the discharge electrode (25) and the counter electrode (26*b*) of the second charge section (20*b*) is increased, the proportion of the impact charging declines, and the diffusion charging tends to occur at the second charge section (20*b*).

Figure 26:
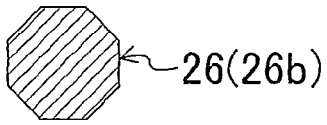
FIG. 26 shows a cross sectional view of a schematic structure of a counter electrode according to other embodiments.

Further, in the above embodiments, a rod-like or columnar electrode having a circular cross section is used as a counter electrode (26*b*) of the second charge section (20*b*). However, an electrode having a polygonal cross section and obtuse-angled corners may be used as the counter electrode (26*b*) as shown in FIG. 26. FIG. 26 shows an example counter electrode (26*a*) whose shape is a regular octagon in cross section. In this case, it is preferable that the diagonal dimension or diameter ω of the counter electrode (26*b*) of the second charge section (20*b*) is one fifth or less of the distance (D) between the discharge electrode (25) and the counter electrode (26*b*), and is greater than zero (mm).

Further, in the second to fourth embodiments, the counter electrode (26*a*) of the first charge section (20*a*) and the counter electrode (26*b*) of the second charge section (20*b*) do not necessarily have to have the same shape. The counter electrode (26*a*) of the first charge section (20*a*) adopting an impact charging technique, may have a plate-like shape or a thick rod-like shape so that ions can be easily injected into the electrode. The counter electrode (26*b*) of the second charge section (20*b*) adopting a diffusion charging technique, may have a thin rod-like shape so that ions cannot be easily injected into the electrode.

Further, the precipitator (30) is not limited to a structure using an electrode plate or the like, but may be a structure using an electrostatic filter. Moreover, the polarities of the electrodes of the charge section (20) and the precipitator (30) are not limited to the polarities described in the above embodiments, but may be reversed, for example.

The sawtooth discharge electrode may be asymmetric as shown in FIG. 27 (A) to 27 (C). FIG. 27 (A) shows an example in which the number of discharge sections on the right side of the discharge electrode, and the number of discharge sections on the left side of the discharge electrode are different. This makes it possible to change the proportion between the impact charging current and the diffusion charging current, from the proportion in the case of symmetric discharge electrode. FIG. 27 (B) shows an example in which the number of discharge sections on both of the left and right sides of the discharge electrode is reduced and the discharge sections are arranged in a staggered manner (the discharge sections are arranged alternately at different locations on each side of the discharge electrode). FIG. 27 (C) shows an example in which the discharge sections are provided at only one of the left and right edges of the strip. Even if these discharge electrodes are used, the dust collection efficiency can be enhanced by appropriately placing the counter electrodes and making the impact charging and the diffusion charging occur simultaneously.

The shape of a tooth of the discharge electrode may be, for example, an isosceles triangle as shown in FIG. 28 (A), a right-angled triangle as shown in FIG. 28 (B), or an obtuse-angled triangle as shown in FIG. 28 (C).

The sawtooth discharge electrode may be generally C-shaped by bending the left and right edges of the sawtooth discharge electrode as shown in FIG. 29 (A), or may be V-shaped as shown in FIG. 29 (B). Even if these discharge electrodes are used, the dust collection efficiency can be enhanced by appropriately placing the counter electrodes and making the impact charging and the diffusion charging occur simultaneously.

The foregoing embodiments are merely preferred examples in nature, and are not intended to limit the scope, applications, and use of the invention.

INDUSTRIAL APPLICABILITY

As described above, the present invention is useful as charging devices and charging methods for charging floating particles such as dust in the air to be handled, and air handling devices and air handling methods for collecting the charged dust.

The invention claimed is:

1. A charging device, comprising:

a charge section for charging a floating particle in an air to be handled, wherein the charge section includes a first charge section adopting an impact charging technique and a second charge section adopting a diffusion charging technique, the first charge section is positioned on an upstream side of a direction of the air to be handled, and the second charge section is positioned on a downstream side of the direction of the air to be handled, a discharge electrode of the first charge section and a discharge electrode of the second charge section are constituted by an integral discharge electrode, and a counter electrode of the first charge section is located on the air flow upstream side, and a counter electrode of the second charge section is located on the air flow downstream side, relative to the discharge electrode.

2. The charging device of claim 1, wherein a discharge electrode provided at the second charge section is a plate-shaped electrode having generally rectangular, plate-shaped projections provided at predetermined intervals along at least one edge of a band-shaped member.

3. The charging device of claim 1, wherein a discharge electrode provided at the second charge section is a sawtooth electrode.

4. The charging device of claim 1, wherein a discharge electrode provided at the second charge section is a needle-shaped electrode.

5. The charging device of claim 2, wherein a counter electrode provided at the second charge section is positioned at a location shifted from a discharge direction of the discharge electrode.

6. The charging device of claim 1, wherein the integral discharge electrode includes a first discharge section which constitutes the discharge electrode of the first charge section, and a second discharge section which constitutes the discharge electrode of the second charge section, and the counter electrode of the first charge section and the counter electrode of the second charge section are constituted by an integral counter electrode, and the integral counter electrode is located closer to the first discharge section than to the second discharge section.

7. The charging device of claim 1, wherein a counter electrode of the second charge section is a rod-shaped electrode having a polygonal cross section and obtuse-angled corners.

8. The charging device of claim 1, wherein a counter electrode of the second charge section is a rod-shaped electrode having a circular cross section.

9. The charging device of claim 7 or claim 8, wherein a diagonal dimension or a diameter of the counter electrode of the second charge section is one fifth or less of a distance between a discharge electrode and the counter electrode, and is greater than zero (mm).

10. The charging device of claim 7, wherein a space is provided in a region opposite to the discharge electrode, relative to the counter electrode of the second charge section.

11. The charging device of claim 7, wherein a space is provided around an entire periphery of the counter electrode of the second charge section.

12. The charging device of claim 10 or claim 11, wherein the counter electrode of the second charge section is located in an air flow path along which the air to be handled flows.

13. The charging device of claim 1, wherein if an electric current flowing in a discharge electrode is represented by I1 and an electric current flowing in a counter electrode is represented by I2, both an impact charging current (I2) and an diffusion charging current (I1-I2) flow in both of the electrodes.

14. The charging device of claim 13, wherein a proportion of the diffusion charging current is 5% or more and 60% or less of an overall electric current.

15. The charging device of claim 14, wherein the proportion of the diffusion charging current is 10% or more and 30% or less of the overall electric current.

16. The charging device of claim 15, wherein the proportion of the diffusion charging current is 15% or more and 30% or less of the overall electric current.

17. An air handling device, comprising:

a charge section for charging dust in an air to be handled, and an electrostatic precipitator for collecting the charged dust, wherein the charge section is constituted by the charging device of claim 1 which includes a first charge section adopting an impact charging technique and a second charge section adopting a diffusion charging technique.

18. The charging device of claim 1, wherein the counter electrode of the first charge section is separated from the counter electrode of the second charge section.

* * * * *